US011532277B2

(12) United States Patent
Nishio et al.

(10) Patent No.: US 11,532,277 B2
(45) Date of Patent: Dec. 20, 2022

(54) DISPLAY DEVICE HAVING A PLURALITY OF DATA LINES FOR DRIVING A PLURALITY OF DISPLAY REGIONS

(71) Applicant: SHARP KABUSHIKI KAISHA, Sakai (JP)

(72) Inventors: Masaaki Nishio, Sakai (JP); Yousuke Nakamura, Sakai (JP); Hongbing Weng, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/440,754

(22) PCT Filed: Mar. 26, 2019

(86) PCT No.: PCT/JP2019/012762
§ 371 (c)(1),
(2) Date: Sep. 17, 2021

(87) PCT Pub. No.: WO2020/194493
PCT Pub. Date: Oct. 1, 2020

(65) Prior Publication Data

US 2022/0189409 A1 Jun. 16, 2022

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2310/08* (2013.01); *G09G 2330/021* (2013.01)

(58) Field of Classification Search
CPC ..... G09G 3/3266
USPC ..... 345/76
See application file for complete search history.

(56) References Cited

U.S. PATENT DOCUMENTS

| | | | | |
|---|---|---|---|---|
| 6,175,351 | B1 | 1/2001 | Matsuura et al. | |
| 2005/0179640 | A1* | 8/2005 | Tanaka | G09G 3/3666 345/103 |
| 2009/0184913 | A1 | 7/2009 | Sato | |
| 2009/0284500 | A1 | 11/2009 | Yamashita | |
| 2018/0158393 | A1* | 6/2018 | Woo | G09G 3/3266 |

(Continued)

FOREIGN PATENT DOCUMENTS

| | | | |
|---|---|---|---|
| JP | H07-056143 | A | 3/1995 |
| JP | 2003-344823 | A | 12/2003 |
| JP | 2009-175303 | A | 8/2009 |

(Continued)

*Primary Examiner* — Long D Pham
(74) *Attorney, Agent, or Firm* — ScienBiziP, P.C.

(57) ABSTRACT

A display panel includes a second display region and a first display region which are arranged side by side in a direction in which data signal lines extend, and a source driver is provided at one edge of the second display region. Switches are provided between data signal lines in the first display region and data signal lines in the second display region, and the switches are turned off when an on-level scanning signal is applied to a scanning signal line in the second display region. A period during which the on-level scanning signal is applied to each scanning signal line in the second display region is shorter than a period during which the on-level scanning signal is applied to each scanning signal line in the first display region.

16 Claims, 22 Drawing Sheets

(56) References Cited

U.S. PATENT DOCUMENTS

2019/0035350 A1 1/2019 Miyata

FOREIGN PATENT DOCUMENTS

| | | | |
|---|---|---|---|
| JP | 2009-276547 | A | 11/2009 |
| WO | 2012/017640 | A1 | 2/2012 |
| WO | 2017/141828 | A1 | 8/2017 |

* cited by examiner

DISPLAY DEVICE HAVING A PLURALITY OF DATA LINES FOR DRIVING A PLURALITY OF DISPLAY REGIONS

TECHNICAL FIELD

The following disclosure relates to a display device, and more specifically to a display device having two or more display regions.

BACKGROUND ART

In recent years, regarding a display device such as an organic EL display device and a liquid crystal display device, an increase in resolution and an increase in the size of a screen have advanced. Due to this, a panel load is large compared with that of a known configuration, increasing power consumption. Moreover, to improve display quality, an increase in luminance is advancing. In terms of this, too, power consumption increases. Further, with the advancement of an increase in resolution, drive time per line is reduced, and in order to implement the reduction in drive time, there is a need to improve the ability of a drive circuit (e.g., an LSI), which leads to an increase in power consumption. Regarding a display device, power consumption has increased as described above, and thus, an increase in the size of the drive circuit and an increase in the performance of peripheral parts are required. Such requirements are particularly remarkable in a display device used for virtual reality (VR) (e.g., a head mounted display). However, an increase in the size of the drive circuit and an increase in the performance of peripheral parts are big factors in cost increase.

In relation to this matter, Japanese Laid-Open Patent Publication No. 2003-344823 and Japanese Laid-Open Patent Publication No. 2009-276547 disclose display devices having a configuration in which switching elements whose on/off is controlled by a control signal are provided on data signal lines (source bus lines). In such a configuration, when a switching element is turned off, a data signal line on one side with respect to the position of the switching element (hereinafter, referred to as "first line".) and a data signal line on the other side (hereinafter, referred to as "second line") go into an electrically disconnected state. Here, assuming that a source driver is directly connected to the first line, when a data signal is written into a pixel circuit connected to the first line, the switching element is turned off. At this time, a wiring load on the data signal line is reduced compared with that of a configuration in which the switching elements are not provided on the data signal lines. By this, power consumption related to driving of the data signal lines is reduced.

PRIOR ART DOCUMENTS

Patent Documents

[Patent Document 1] Japanese Laid-Open Patent Publication No. 2003-344823

[Patent Document 2] Japanese Laid-Open Patent Publication No. 2009-276547

SUMMARY

Problems to be Solved by the Invention

Meanwhile, in recent years, for example, in order to achieve an improvement in display quality upon display of a moving image/an increase in frame rate has advanced. In addition, regarding a display device including a touch panel, in order to increase the accuracy of touch detection, there is a demand for the securing of a sufficiently long period for touch detection during a period during which drive operation for display is not performed. From the above-described facts, there is a problem about the reduction in drive time per scanning signal line over that of a known configuration. Neither of Japanese Laid-Open Patent Publication No. 2003-344823 and Japanese Laid-Open Patent Publication No. 2009-276547 mentions the reduction in drive time of the scanning signal lines.

An object of the following disclosure is therefore to implement a display device that can reduce drive time per scanning signal line compared to the known configuration while reducing power consumption.

Means for Solving The Problems

A display device according to some embodiments of the present disclosure is a display device that displays an image by writing a data signal into a plurality of pixel circuits arranged in a display panel, wherein the display panel includes:

- a plurality of data signal lines configured to transmit the data signal;
- a plurality of scanning signal lines intersecting the plurality of data signal lines;
- the plurality of pixel circuits provided at intersecting portions of the plurality of data signal lines and the plurality of scanning signal lines, the plurality of pixel circuits forming a pixel matrix of a plurality of rows× a plurality of columns;
- a data signal line drive circuit configured to apply the data signal to the plurality of data signal lines;
- a scanning signal line drive circuit configured to apply a scanning signal to the plurality of scanning signal lines; and
- a first display region and a second display region in which the plurality of data signal lines are disposed, the first display region and the second display region are arranged side by side in a direction in which the plurality of data signal lines extend, each of the plurality of data signal lines includes a first data signal line disposed in the first display region and a second data signal line disposed in the second display region, the plurality of scanning signal lines include a plurality of first scanning signal lines disposed in the first display region and a plurality of second scanning signal lines disposed in the second display region, the data signal line drive circuit is provided at one edge of the second display region so that the data signal is applied to the second data signal line earlier than the first data signal line, the display panel further includes a first switching element provided for each of the plurality of data signal lines, the first switching element having a control terminal to which a first switching signal is provided, a first conductive terminal connected to the first data signal line, and a second conductive terminal connected to the second data signal line, when the scanning signal line drive circuit applies an on-level scanning signal to any of the plurality of first scanning signal lines, the first switching element is in an on state, when the scanning signal line drive circuit applies an on-level scanning signal to any of the plurality of second scanning signal lines, the first switching element is in an off state, and the scanning signal line drive circuit sets a second writing period shorter than a first writing period, the second writing period being a period during which an on-level scanning signal is applied to each of the plurality of second scanning signal lines so that the data signal is written into pixel circuits included in the second display region, and the first writing period being a period during which an on-level scanning signal is applied to each of the plurality of first scanning signal lines so that the data signal is written into pixel circuits included in the first display region.

A display device according to some other embodiments of the present disclosure is a display device that displays an image by writing a data signal into a plurality of pixel circuits arranged in a display panel, wherein the display panel includes:

a plurality of data signal lines configured to transmit the data signal;

a plurality of scanning signal lines intersecting the plurality of data signal lines;

the plurality of pixel circuits provided at intersecting portions of the plurality of data signal lines and the plurality of scanning signal lines, the plurality of pixel circuits forming a pixel matrix of a plurality of rows× a plurality of columns;

a data signal line drive circuit configured to apply the data signal to the plurality of data signal lines;

a scanning signal line drive circuit configured to apply a scanning signal to the plurality of scanning signal lines; and a first display region and a second display region in which the plurality of data signal lines are disposed, the first display region and the second display region are arranged side by side in a direction in which the plurality of data signal lines extend, each of the plurality of data signal lines includes a first data signal line disposed in the first display region and a second data signal line disposed in the second display region, the plurality of scanning signal lines include a plurality of first scanning signal lines disposed in the first display region and a plurality of second scanning signal lines disposed in the second display region, the data signal line drive circuit is provided at one edge of the second display region so that the data signal is applied to the second data signal line earlier than the first data signal line, the display panel further includes a first switching element provided for each of the plurality of data signal lines, the first switching element having a control terminal to which a first switching signal is provided, a first conductive terminal connected to the first data signal line, and a second conductive terminal connected to the second data signal line, when the scanning signal line drive circuit applies an on-level scanning signal to any of the plurality of first scanning signal lines, the first switching element is in an on state, when the scanning signal line drive circuit applies an on-level scanning signal to any of the plurality of second scanning signal lines, the first switching element is in an off state, as display nodes, a first node in which drive frequency is a first frequency and a second node in which drive frequency is a second frequency higher than the first frequency are prepared, in the first node, a first writing period has a same length as a second writing period, the first writing period being a period during which an on-level scanning signal is applied to each of the plurality of first scanning signal lines so that the data signal is written into pixel circuits included in the first display region, and the second writing period being a period during which an on-level scanning signal is applied to each of the plurality of second scanning signal lines so that the data signal is written into pixel circuits included in the second display region, and in the second mode, the second writing period is shorter than the first writing period.

A display device according to some still other embodiments of the present disclosure is a display device chat displays an image by writing a data signal into a plurality of pixel circuits arranged in a display panel, wherein the display panel includes:

a plurality of data signal lines configured to transmit the data signal;

a plurality of scanning signal lines intersecting the plurality of data signal lines;

the plurality of pixel circuits provided at intersecting portions of the plurality of data signal lines and the plurality of scanning signal lines, the plurality of pixel circuits forming a pixel matrix of a plurality of rows× a plurality of columns;

a data signal line drive circuit configured to apply the data signal to the plurality of data signal lines;

a scanning signal line drive circuit configured to apply a scanning signal to the plurality of scanning signal lines; and a first display region and a second display region in which the plurality of data signal lines are disposed, the first display region and the second display region are arranged side by side m a direction in which the plurality of data signal lines extend, each of the plurality of data signal lines includes a first data signal line disposed in the first display region and a second data signal line disposed in the second display region, the plurality of scanning signal lines include a plurality of first scanning signal lines disposed in the first display region and a plurality of second scanning signal lines disposed in the second display region, the data signal line drive circuit is provided at one edge of the second display region so that the data signal is applied to the second data signal line earlier than the first data signal line, the display panel further includes a first switching element provided for each of the plurality of data signal lines, the first switching element having a control terminal to which a first switching signal is provided, a first conductive terminal connected to the first data signal line, and a second conductive terminal connected to the second data signal line, when the scanning signal line drive circuit applies an on-level scanning signal to any of the plurality of first scanning signal lines, the first switching element is in an on state, when the scanning signal line drive circuit applies an on-level scanning signal to any of the plurality of second scanning signal lines, the first switching element is in an off state, as display inodes, a first mode in which drive frequency is a first frequency and a second mode in which drive frequency is a second frequency higher than the first frequency are prepared, in the first mode, a first vertical scanning period has a same length as a second vertical scanning period, the first vertical scanning period being a period during which an on-level scanning signal is sequentially applied to the plurality of first scanning signal lines, and the second vertical scanning period being a period during which an on-level scanning signal is sequentially applied to the plurality of second scanning signal lines, and in the second mode, the second vertical scanning period is shorter than the first vertical scanning period.

Effects of the Invention

According to some embodiments of the present disclosure, in a display device, two display regions (a first display region and a second display region) are provided in a display panel. Further, in the display panel there is provided a first switching element that controls a state of electrical connection between a first data signal line disposed in the first display region and a second data signal line disposed in the second display region, and a first switching signal is provided to a control terminal of the first switching element. Thus, by changing the level of the first switching signal, on/off of the first switching element can be controlled. Here, since a data signal line drive circuit is provided at one edge of the second display region, when writing of a data signal into pixel circuits in the second display region is performed, the first data signal line and the second data signal line can be brought into an electrically disconnected state by turning off the first switching element. By this, wiring loads on data signal lines upon writing the data signal into the pixel circuits in the second display region are reduced over those of an original configuration, reducing power consumption compared with that of a known configuration. In addition, when the wiring loads on the data signal lines are reduced over those of the original configuration, a data signal writing period can be reduced to the extent that problems concerning display do not occur. That is, drive time per scanning signal line can be reduced over that of the known configuration. As described above, a display device is implemented that can reduce drive time per scanning signal line compared to the known configuration while reducing power consumption.

According to some other embodiments of the present disclosure, in a display device in which two switchable modes are prepared, drive time per scanning signal line can be reduced compared to the known configuration while reducing power consumption.

BRIEF DESCRIPTION OF THE DRAWINGS

FIG. 26 is a signal waveform diagram for describing differences in the waveforms of a gate clock signal and a scanning signal between a first vertical scanning period, a second vertical scanning period, and a third vertical scanning period in the variant.

MODES FOR CARRYING OUT THE INVENTION

Embodiments will be described below with reference to the accompanying drawings. Note that in the following, N and J are assumed to be integers greater than or equal to 2, M is assumed to be an integer greater than or equal to 4, p is assumed to be an integer between 1 and H, inclusive, and q is assumed to be an integer between 1 and J, inclusive.

1. First Embodiment

[1.1 Functional Configuration]

Figure 2:
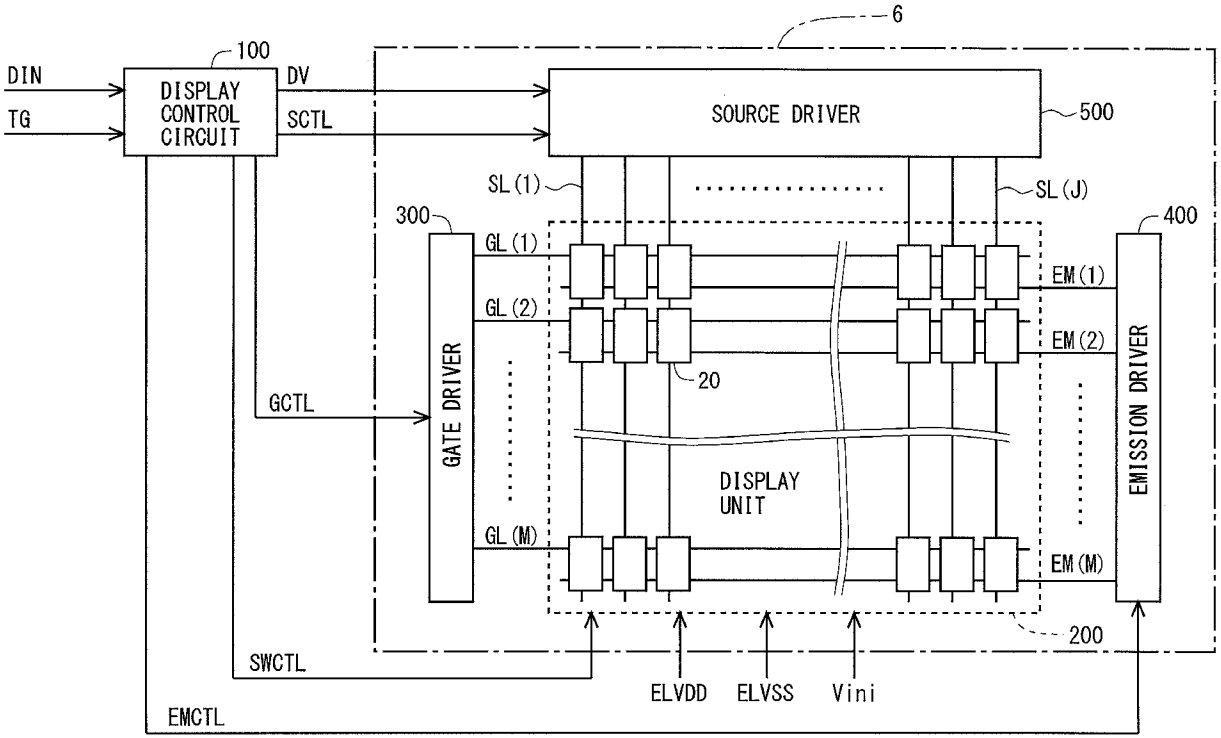
FIG. 2 is a block diagram showing a functional configuration of an organic EL display device according to the first embodiment.

FIG. 2 is a block diagram showing a functional configuration of an organic EL display device according to a first embodiment. As shown in FIG. 2, the organic EL display device includes a display control circuit 100, a display unit 200, a gate driver (scanning signal line drive circuit) 300, an emission driver (light emission control line drive circuit) 400, and a source driver (data signal line drive circuit) 500. In the present embodiment, the gate driver 300, the emission driver 400, and the source driver 500 are included in an organic EL display panel (hereinafter, referred to as "organic EL panel".) 6 including the display unit 200. Regarding this, typically, the gate driver 300 and the emission driver 400 are monolithically formed. Note, however, that a configuration in which they are not monolithically formed can also be adopted. The source driver 500 may also be monolithically formed or may not be monolithically formed. In addition, the source driver 500 may be directly provided on the organic EL panel 6 or may be formed of a circuit in a chip mounted on the organic EL panel 6.

In the display unit 200 there are disposed J data signal lines SL(1) to SL(J) and M scanning signal lines GL(1) to GL(M) orthogonal to the J data signal lines SL(1) to SL(J). Moreover, in the display unit 200, M light emission control lines EM(1) to EM (M) are disposed so as to have a one-to-one correspondence with the M scanning signal lines GL(1) to GL(M). The scanning signal lines GL(1) to GL(M) and the light emission control lines EM(1) to EM(M) are typically parallel to each other. Furthermore, in the display unit 200, M×J pixel circuits 20 are provided at intersecting portions of the J data signal lines SL(1) to SL(J) and the M scanning signal lines GL(1) to GL(M). By thus providing the M×J pixel circuits 20, a pixel matrix of M rows×J columns is formed in the display unit 200. In the following, scanning signals provided to the respective M scanning signal lines GL(1) to GL(M) are also given reference characters GL(1) to GL(M), light emission control signals provided to the respective M light emission control lines EM(1) to EM(M) are also given reference characters EM(1) to EM(M), and data signals provided to the respective J data signal lines SL(1) to SL(J) are also given reference characters SL(1) to SL(J), as necessary. Note that the display unit 200 of the present embodiment includes two display regions (a first display region and a second display region), the detailed description of which will be made later.

In the display unit 200 there are also disposed power supply lines (not shown) common to the pixel circuits 20. More specifically, there are disposed a power supply line (hereinafter, referred to as "high-level power supply line") that supplies a high-level power supply voltage ELVDD for driving organic EL light-emitting elements (hereinafter, referred to as "organic EL element"., a power supply line (hereinafter, referred to as "low-level power supply line") that supplies a low-level power supply voltage ELVSS for driving the organic EL elements, and a power supply line (hereinafter, referred to as "initialization power supply line") that supplies an initialization voltage Vini. The high-level power supply voltage ELVDD, the low-level power supply voltage ELVSS, and the initialization voltage Vini are supplied from a power supply circuit which is not shown.

The operation of each component shown in FIG. 2 will be described below. The display control circuit 100 receives an input image signal DIN and a timing signal group (a horizontal synchronizing signal, a vertical synchronizing signal, etc.) TG which are transmitted from an external source, and outputs digital video signals DV, gate control signals GCTL that control the operation of the gate driver 300, emission driver control signals EMCTL that control the operation of the emission driver 400, source control signals SCTL that control the operation of the source driver 500, and a switch control signal SWCTL whose details will be described later. The gate control signals GCTL include a gate start pulse signal, a gate clock signal, etc. The emission driver control signals EMCTL include an emission start pulse signal, an emission clock signal, etc. The source control signals SCTL include a source start pulse signal, a source clock signal, a latch strobe signal, etc.

The gate driver 300 is connected to the M scanning signal lines GL(1) to GUM). The gate driver 300 applies scanning signals to the M scanning signal lines GL(1) to GL(m), based on the gate control signals GCTL outputted from the display control circuit 100.

The emission driver 400 is connected to the M light emission control lines EM(1) to EM(M). The emission driver 400 applies light emission control signals to the M light emission control lines EM(1) to EM(M), based on the emission driver control signals EMCTL outputted from the display control circuit 100.

The source driver 500 includes a J-bit shift register, a sampling circuit, a latch circuit, J D/A converters, etc., which are not shown. The shift register has J cascade-connected registers. The shift register sequentially transfers a pulse of the source start pulse signal supplied to a register at an initial stage, from an input terminal to an output terminal, based on the source clock signal. According to the transfer of the pulse, a sampling pulse is outputted from each stage of the shift register. Based on the sampling pulse, the sampling circuit stores a digital video signal DV. The latch circuit captures and holds digital video signals DV for one row which are stored in the sampling circuit, in accordance with the latch strobe signal. The D/A converters are provided so as to correspond to the respective data signal lines SL(1) to SL(J). The D/A converters convert the digital video signals DV held in the latch circuit into analog voltages. The converted analog voltages are simultaneously applied, as data signals, to all data signal lines SL(1) to SL(J).

In the above-described manner, the data signals are applied to the J data signal lines SL(1) to SL(J), the scanning signals are applied to the M scanning signal lines GL(1) to GL(M), and the light emission control signals are applied to the M light emission control lines EM(1) to EM(M), by which an image based on the input image signal DIN is displayed on the display unit 200.

<1.2 Display Unit>

Figure 3:
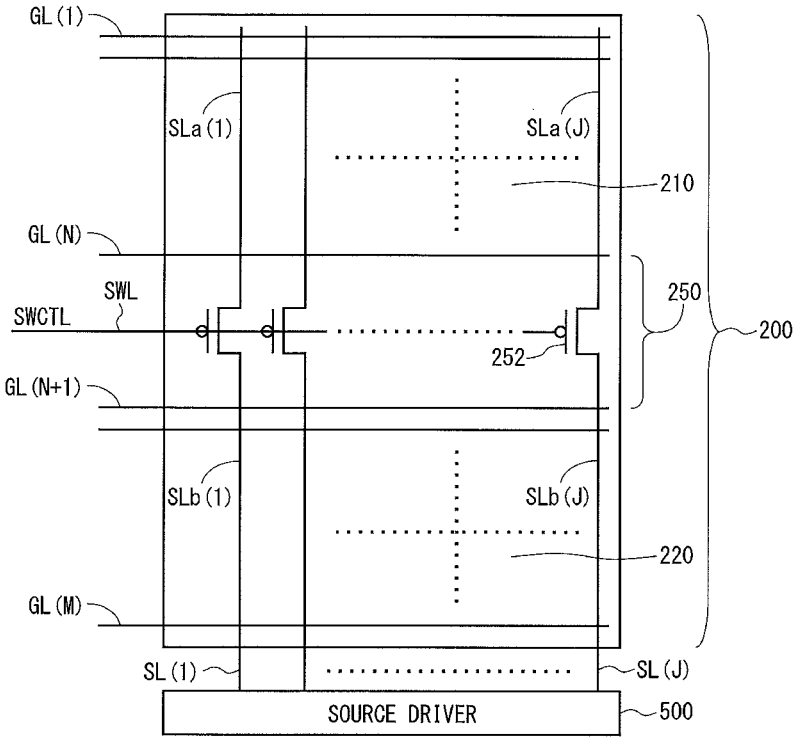
FIG. 3 is a diagram for describing a configuration of a display unit of the organic EL display device according to the first embodiment.

Next, with reference to FIG. 3, the display unit 200 of the present embodiment will be described in detail. As shown in FIG. 3, the display unit 200 includes a first display region 210 and a second display region 220. Different images can be displayed in the first display region 210 and the second display region 220. The first display region 210 and the second display region 220 are arranged side by side in a direction in which the data signal lines SL(1) to SL(J) extend. A connection control part 250 is provided in a region between the first display region 210 and the second display region 220. In addition, as shown in FIG. 3, each data signal line SL Includes a portion disposed in the first display region 210 and a portion disposed in the second display region 220. Here, data signal lines disposed in the first display region 210 are referred to as "first data signal lines", and data signal lines disposed in the second display region 220 are referred to as "second data signal lines". A data signal line indicated by reference character including "a" is a first data signal line, and a data signal line indicated by reference character including "b" is a second data signal line. The source driver 500 is provided at one edge of the second display region 220 so that data signals are applied to second data signal lines SLb earlier than first data signal lines SLa. In other words, the source driver 500 is provided on one side (a lower side in FIG. 3) with respect to the second display region 220, and the first display region 210 is provided on the other side (an upper side in FIG. 3) with respect to the second display region 220 via the connection control part 250.

In the connection control part 250 between the first display region 210 and the second display region 220, a switching signal line SWL extending in parallel to the M scanning signal lines GL(1) to GL(M) is disposed so as to intersect the J data signal lines SL(1) to SL(J). Furthermore, the connection control part 250 includes J switches (analog switches) 252 provided at intersecting portions of the J data signal lines SL(1) to SL(J) and the switching signal line SWL. By the switches 252, first switching elements are implemented. First data signal lines SLa(l) to SLa(J); and second data signal lines SLb(1) to SLb(J) are connected to each other through their corresponding switches 252. The switching signal line SWL transmits a switch control signal SWCTL that controls on/off of the J switches 252. Each switch 252 is connected at its control terminal to the switching signal line SWL, connected at its first conductive terminal to a corresponding first data signal line SLa through a contact hole, and connected at its second conductive terminal to a corresponding second data signal line SLb through a contact hole. By such a configuration, the switch 252 functions to control a state of electrical connection between the first data signal line SLa and the second data signal line SLb. Note that the organic EL panel 6 may be foldable, and the connection control part 250 may be provided at a folding portion of the organic EL panel 6.

The M scanning signal lines GL(1) to GL(M) include, as shown in FIG. 3, scanning signal lines GL(1) to GL(N) disposed in the first display region 210 and scanning signal lines GL(N+1) to GL(M) disposed in the second display region 220. Here, the scanning signal lines GL(1) to GL(N) disposed in the first display region 210 are referred to as "first scanning signal lines", and the scanning signal lines GL(N+1) to GL(M) disposed in the second display region 220 are referred to as "second scanning signal lines".

Note that, typically, a semiconductor layer of the switch 252 is formed in the same layer as a semiconductor layer that forms the pixel circuit 20, and using the same material as the semiconductor layer that forms the pixel circuit 20. In the present embodiment, the switch 252 is implemented by a p-channel thin-film transistor (TFT). Note, however, that the configuration is not limited thereto, and the switch 252 may be implemented by an element other than a p-channel thin-film transistor.

<1.3 Pixel Circuits>

Figure 4:
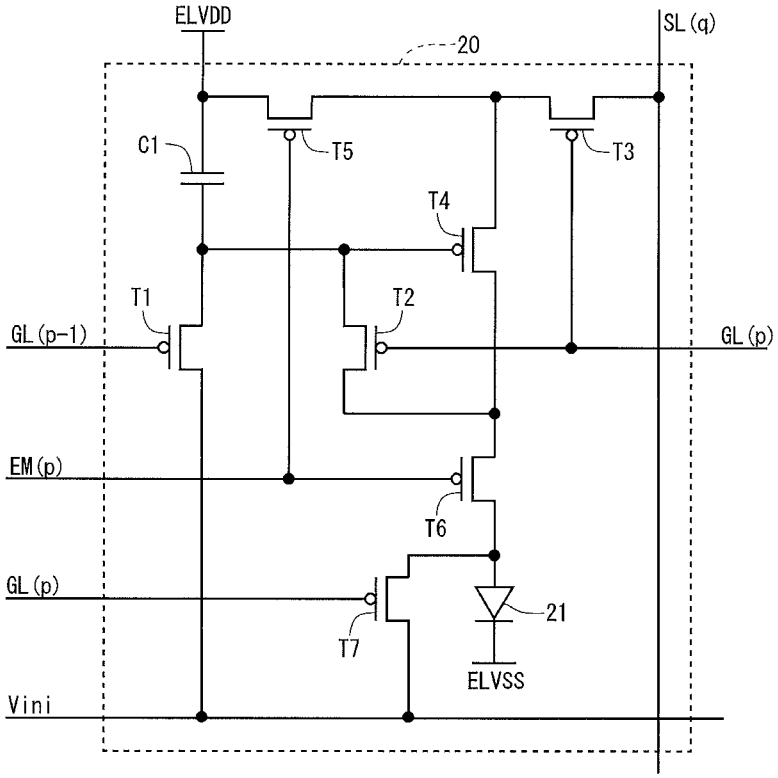
FIG. 4 is a circuit diagram showing a configuration of a pixel circuit provided in row p and column q in the first embodiment.

Next, the configuration and operation of the pixel circuit 20 in the display unit 200 will be described. Note that the configuration of the pixel circuit 20 shown here is an example and the configuration is not limited thereto. FIG. 4 is a circuit diagram showing a configuration of a pixel circuit 20 provided in row p and column q. The pixel circuit 20 shown in FIG. 4 includes one organic EL element (organic light-emitting diode) 21 which is a display element; seven transistors T1 to T7 (an initialization transistor T1, a threshold voltage compensation transistor T2, a write control transistor T3, a drive transistor T4, a power supply control transistor T5, a light emission control transistor T6, and an anode control transistor T7); and one holding capacitor C1. The transistors T1 to T7 are p-channel thin-film transistors. The holding capacitor C1 is a capacitive element composed of two electrodes (a first electrode and a second electrode).

The initialization transistor T1 is connected at its control terminal to a scanning signal line GL(p−1) in a (p−1)th row, connected at its first conductive terminal to a second conductive terminal of the threshold voltage compensation transistor T2, a control terminal of the drive transistor T4, and a second electrode of the holding capacitor C1, and connected at its second conductive terminal to the initialization power supply line. The threshold voltage compensation transistor 72 is connected at its control terminal to a scanning signal line GL(p) in a pth row, connected at its first conductive terminal to a second conductive terminal of the drive transistor T4 and a first conductive terminal of the light emission control transistor T6, and connected at its second conductive terminal to the first conductive terminal of the initialization transistor 71, the control terminal of the drive transistor 14, and the second electrode of the holding capacitor C1. The write control transistor T3 is connected at its control terminal to the scanning signal line GL(p) in the pth row, connected at its first conductive terminal to a data signal line SL(q) in a qth column, and connected at its second conductive terminal to a first conductive terminal of the drive transistor T4 and a second conductive terminal of the power supply control transistor T5. The drive transistor T4 is connected at its control terminal to the first conductive terminal of the initialization transistor T1, the second conductive terminal of the threshold voltage compensation transistor T2, and the second electrode of the holding capacitor C1, connected at its first conductive terminal to the second conductive terminal of the write control transistor T3 and the second conductive terminal of the power supply control transistor T5, and connected at its second conductive terminal to the first conductive terminal of the threshold voltage compensation transistor T2 and the first conductive terminal of the light emission control transistor T6.

The power supply control transistor T5 is connected at its control terminal to a light emission control line EM (p) in the pth row, connected at its first conductive terminal to a high-level power supply line and a first electrode of the holding capacitor C1, and connected at its second conductive terminal to the second conductive terminal of the write control transistor T3 and the first conductive terminal of the drive transistor T4. The light emission control transistor T6 is connected at its control terminal to the light emission control line EM(p) in the pth row, connected at its first conductive terminal to the first conductive terminal of the threshold voltage compensation transistor T2 and the second conductive terminal of the drive transistor T4, and connected at its second conductive terminal to a first conductive terminal of the anode control transistor T7 and an anode terminal of the organic EL element 21. The anode control transistor T7 is connected at its control terminal to a scanning signal line GL(p) in the pth row, connected at its first conductive terminal to the second conductive terminal of the light emission control transistor T6 and the anode terminal of the organic EL element 21, and connected at its second conductive terminal to the initialization power supply line. The holding capacitor C1 is connected at its first electrode to the high-level power supply line and the first conductive terminal of the power supply control transistor T5, and connected at its second electrode to the first conductive terminal of the initialization transistor T1, the second conductive terminal of the threshold voltage compensation transistor T2, and the control terminal of the drive transistor T4. The organic EL element 21 is connected at its anode terminal to the second conductive terminal of the light emission control transistor T6 and the first conductive terminal of the anode control transistor T7, and connected at its cathode terminal to the low-level power supply line.

Figure 5:
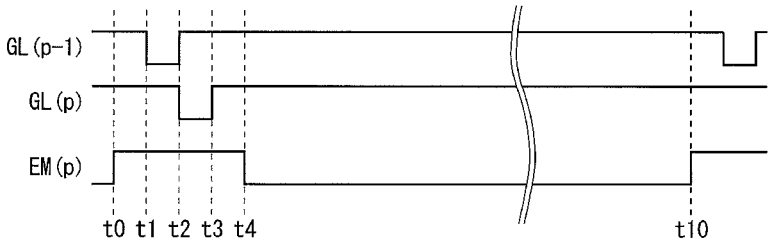
FIG. 5 is a signal waveform diagram for describing a drive method for the pixel circuit provided in row p and column q in the first embodiment.

FIG. 5 is a signal waveform diagram for describing a drive method for the pixel circuit 20 provided in row p and column q (the pixel circuit 20 shown in FIG. 4). Prior to time t0, a scanning signal GL(p−1) and a scanning signal GL(p) are at a high level, and a light emission control signal EM(p) is at a low level. At this time, the power supply control transistor T5 and the light emission control transistor T6 are in an on state, and the organic EL element 21 emits light depending on the magnitude of a drive current.

At time t0, the light emission control signal EM(p) changes from the low level to a high level. By this, the power supply control transistor T5 and the light emission control transistor T6 go into an off state. As a result, the supply of a current to the organic EL element 21 is interrupted, and the organic EL element 21 goes Into a turn-off state.

At time t1, the scanning signal GL(p−1) changes from the high level to a low level. By this, the initialization transistor T1 goes into an on state. As a result, a gate voltage of the drive transistor T4 is initialized. That is, the gate voltage of the drive transistor T4 becomes equal to an initialization voltage Vini.

At time t2, the scanning signal GL(p−1) changes from the low level to the high level. By this, the initialization transistor T1 goes into an off state. In addition, at time t2, the scanning signal GL(p) changes from the high level to a low level. By this, the threshold voltage compensation transistor T2, the write control transistor T3, and the anode control transistor T7 go into an on state. By the anode control transistor T7 going into an on state, an anode voltage of the organic EL element 21 is initialized based on the initialization voltage Vini. Further, by the threshold voltage compensation transistor T2 and the write control transistor T3 going into an on state, a data signal SL(q) is provided to the second electrode of the holding capacitor C1 through the write control transistor 73, the drive transistor 74, and the threshold voltage compensation transistor 72. By this, the holding capacitor C1 is charged.

At time t3, the scanning signal GL(p) changes from the low level to the high level. By this, the threshold voltage compensation transistor T2, the write control transistor T3, and the anode control transistor T7 go into an off state.

At time t4, the light emission control signal EM(p) changes from the high level to the low level. By this, the power supply control transistor T5 and the light emission control transistor T6 go into an on state. By this, a drive current based on the charged voltage of the holding capacitor C1 is supplied to the organic EL element 21. As a result, the organic EL element 21 emits light depending on the magnitude of the drive current. Thereafter, the organic EL element 21 emits light throughout a period up to when the light emission control signal EM(p) changes from the low level to the high level at time t10.

<1.4 Regarding Driving Of The Data Signal Lines>

Meanwhile, regarding driving of the data signal lines, it is also possible to adopt a drive scheme called "SSD" in which an output (i.e., a data signal) from the source driver 500 is shared between a plurality of data signal lines. Note that the "SSD" is an abbreviation of "source shared driving".

Figure 6:
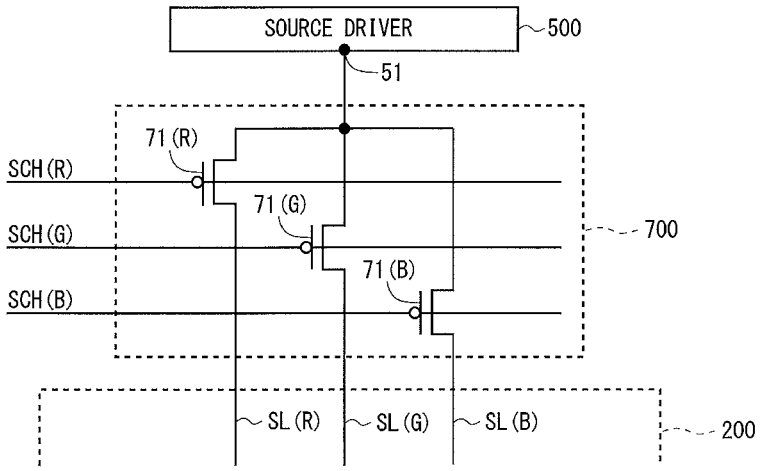
FIG. 6 is a circuit diagram for describing SSD in the first embodiment.

FIG. 6 is a circuit diagram for describing the SSD. In an organic EL display device adopting the SSD, as shown in FIG. 6, a demultiplexer unit 700 for distributing each data signal to a plurality of (three in this example) data signal lines SL is provided between the display unit 200 and the source driver 500. In the example shown in FIG. 6, the demultiplexer unit 700 is composed of a switch 71(R) for controlling a state of electrical connection between an output portion 51 that outputs a data signal and a data signal line SL(R) for red; a switch 71(G) for controlling a state of electrical connection between the output portion 51 and a data signal line SMG) for green; and a switch 71(B) for controlling a state of electrical connection between the output portion 51 and a data signal line SL (B) for blue. Note that FIG. 6 only shows components provided for one output portion 51.

Figure 7:
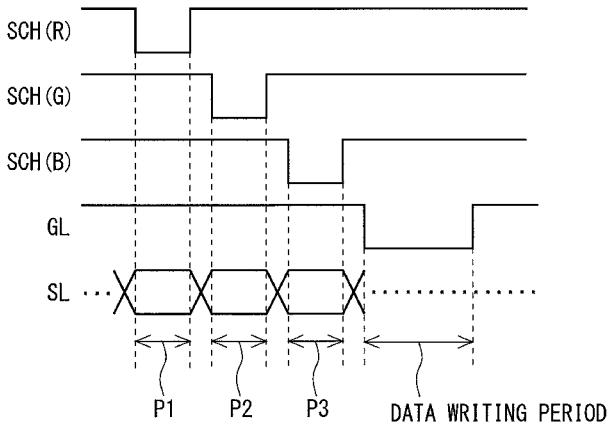
FIG. 7 is a signal waveform diagram for describing the SSD in the first embodiment.
Figure 8:
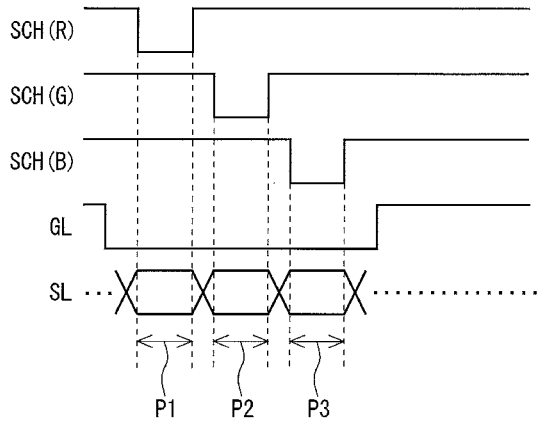
FIG. 8 is a signal waveform diagram for describing the SSD in the first embodiment.

In a configuration such as that described above, as shown in FIG. 7, during a period a bit before a data writing period, the switch 71(R), the switch 71(G), and the switch 71(B) are sequentially turned on for a predetermined period. The source driver 500 outputs a data signal for red during a period P1, outputs a data signal for green during a period P2, and outputs a data signal for blue during a period P3. By this, desired data signals are sequentially supplied to the data signal line SL(R) for red, the data signal line SL(G) for green, and the data signal line SMB) for blue. Then, with the data signal line SL(R) for red, the data signal line SL(G) for green, and the data signal line SL(B) for blue being charged based on the data signals, writing of the data signals into a pixel circuit for red, a pixel circuit for green, and a pixel circuit for blue is performed during a data writing period. Based on such writing, an image is displayed on the display unit 200. Note that, by sequentially turning on the switch 71(R), the switch 71(G), and the switch 71(B) for a predetermined period during a period during which a scanning signal GL is maintained at a low level as shown in FIG. 8, too, writing of data signals into a pixel circuit for red, a pixel circuit for green, and a pixel circuit for blue is performed sc that a desired image is displayed on the display unit 200. Although here description is made using an example in which a data signal outputted from one output portion 51 is distributed to three data signal lines SL, the configuration is not limited thereto. A configuration can be adopted in which with k being an integer greater than or equal to 2, a data signal outputted from one output portion 51 is distributed to k data signal lines SL.

By adopting the SSD such as that described above, the number of data signal lines SL to be disposed in a picture-frame region is reduced, and thus, even if an increase in resolution advances, an increase of the picture-frame region can be suppressed.

<1.5 Drive Method For The Organic EL Panel>

<1.5.1 Control of the Switches in the Connection Control Part>

Figure 9:
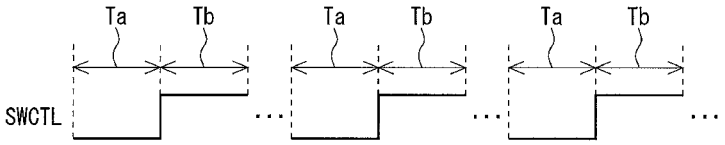
FIG. 9 is a signal waveform diagram for describing on/off control of switches provided in a connection control part in the first embodiment.

FIG. 9 is a signal waveform diagram for describing on/off control of the switches 252 provided in the connection control part 250. Note that a period during which writing of data signals into pixel circuits 20 included in the first display region 210 is performed by sequentially applying an on-level scanning signal to the first scanning signal lines GL(1) to GL(N) is hereinafter referred to as "first vertical scanning period", and a period during which writing of data signals into pixel circuits 20 included in the second display region 220 is performed by sequentially applying an on-level scanning signal to the second scanning signal lines GL(N+1) to GL(M) is hereinafter referred to as "second vertical scanning period". The first vertical scanning period is given reference character Ta, and the second vertical scanning period is given reference character Tb.

During the first vertical scanning period Ta, as shown in FIG. 9, the switch control signal SWCTL is at a low level. Since the switches 252 are p-channel thin-film transistors, the switches 252 are in an on state during the first vertical scanning period Ta. By this, the first data signal lines SLa and the second data signal lines SLb go into an electrically connected state. In such a state, the source driver 500 applies data signals to the data signal lines SL(1) to SL(J), depending on a target display image for the first display region 210.

During the second vertical scanning period Tb, as shown in FIG. 9, the switch control signal SWCTL is at a high level. Since the switches 252 are p-channel thin-film transistors, the switches 252 are in an off state during the second vertical scanning period Tb. By this, the first data signal lines SLa and the second data signal lines SLb go into an electrically disconnected state. In such a state, the source driver 500 applies data signals to the data signal lines SL(1) to SL(J), depending on a target display image for the second display region 220. At this time, wiring loads on the data signal lines SL are smaller than those of an original configuration (a known configuration in which the switches 252 are not provided).

As described above, during the first vertical scanning period Ta, data signals need to be supplied to the first data signal lines SLa (data signal lines in the first display region 210), and thus, by bringing the switches 252 into an on state, the first data signal lines SLa and the second data signal lines SLb go into an electrically connected state. During the second vertical scanning period Tb, there is no need to supply data signals to the first data signal lines SLa, and thus, in order to reduce wiring loads, by bringing the switches 252 into an off state, the first data signal lines SLa and the second data signal lines SLb go into an electrically disconnected state.

<1.5.2 Details>

Figure 10:
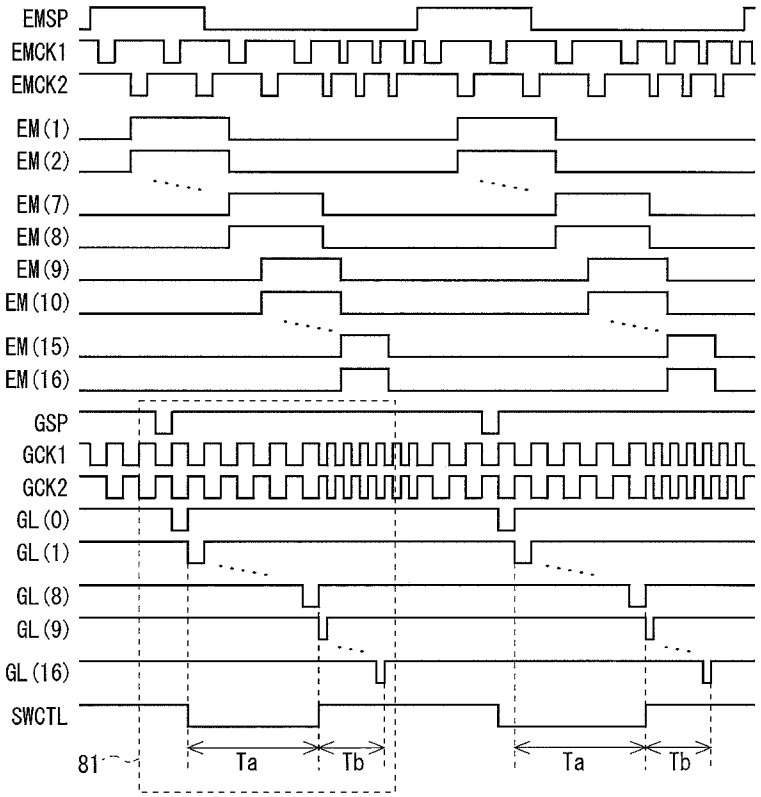
FIG. 10 is a signal waveform diagram for describing details of a drive method in the first embodiment.

FIG. 10 is a signal waveform diagram for describing details of a drive method of the present embodiment. Note that a period from a fall time point to a next fall time point of a gate start pulse signal GSP is defined as "vertical period". The vertical period includes an effective vertical scanning period and a vertical flyback period. The effective vertical scanning period is a period during which writing of data signals into the pixel circuits 20 is performed by sequentially scanning the plurality of scanning signal lines GL in the display unit 200. In the present embodiment, the effective vertical scanning period includes a first vertical scanning period Ta and a second vertical scanning period Tb.

Here, it is assumed that the number of scanning signal lines GL and the number of light emission control lines EM are 16, scanning signal lines GL(1) to GL(8) and light emission control lines EM(1) to EM(8) are disposed in the first display region 210, and scanning signal lines GL(9) to GL(16) and light emission control lines EM(9) to EM(16) are disposed in the second display region 220 (the same also applies to the second to fourth embodiments). That is, the scanning signal lines GL(1) to GL (8) are first scanning signal lines, and the scanning signal lines GL(9) to GL(16) are second scanning signal lines. As such, although description will be made using an example in which the switches 252 are provided such that the number of first scanning signal lines is equal to the number of second scanning signal lines, the configuration is not limited thereto, and the switches 252 may be provided such that the number of first scanning signal lines differs from the number of second scanning signal lines. Note that in FIG. 10, GL(0) indicates a scanning signal applied to a dummy scanning signal line that does not involve in image display (the same also applies to FIGS. 12, 15, and 17).

Regarding FIG. 10, we focus on a period from a given rise time point to a next rise time point of an emission start pulse signal EMSP (hereinafter, referred to as "unit period" for the sake of convenience). The length of the unit period is equal to the length of the vertical period. In the present embodiment, the potentials of two light emission control lines EM go to a high level during the unit period, based on emission clock signals EMCK1 and EMCK2. Note, however, that the configuration is not limited thereto, and the potential of one light emission control line EM nay go to a high level during the unit period. During a period during which the potential of a light emission control line EM is at a high level, in a corresponding pixel circuit 20 (see FIG. 4), a power supply control transistor T5 and a light emission control transistor T6 are in an off state, and thus, an organic EL element 21 is turned off. During a period during which the organic EL element 21 is thus turned off, writing of a data signal into the pixel circuit 20 is performed.

As can be grasped from FIG. 10, during the unit period, after the gate start pulse signal GSP is changed from a high level to a low level, scanning signals GL(0) to GL(16) sequentially go to a low level for a predetermined period, based on gate clock signals (scanning clock signals) GCK1 and GCK2. Note, however, that the length of a period during which the low level is maintained differs between the scanning signals GL(0) to GL(8) and the scanning signals GL(9) to GL(16).

Here, we focus on a first vertical scanning period Ta. During the first vertical scanning period Ta, the scanning signals GL(1) to GL(8) sequentially go to a low level for a predetermined period. By this, during the first vertical scanning period Ta, writing of data signals into pixel circuits 20 in the first display region 210 is performed. At this time, the switch control signal SWCTL is at the low level. Hence, the switches 252 in the connection control part 250 are in an on state. Thus, the first data signal lines SLa and the second data signal lines SLb are in an electrically connected state, and data signals are supplied to the first data signal lines SLa from the source driver 500 through the second data signal lines SLb.

Next, we focus on a second vertical scanning period Tb. During the second vertical scanning period Tb, the scanning signals GL(9) to GL(16) sequentially go to a low level for a predetermined period. By this, during the second vertical scanning period Tb, writing of data signals into pixel circuits 20 in the second display region 220 is performed. At this time, the switch control signal SWCTL is at a high level. Hence, the switches 252 in the connection control part 250 are in an off state. Thus, the first data signal lines SLa and the second data signal lines SLb are in an electrically disconnected state, and wiring loads on the data signal lines SL are remarkably smaller than those of the original configuration.

Figure 1:
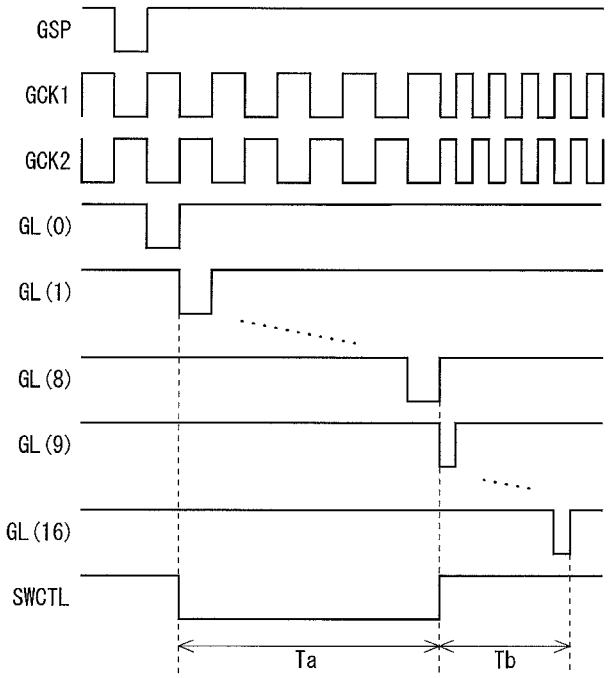
FIG. 1 is a signal waveform diagram for an effective vertical scanning period of a first embodiment.
Figure 11:
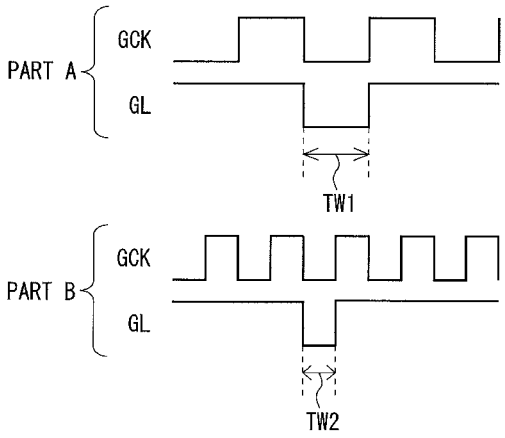
FIG. 11 is a signal waveform diagram for describing differences in the waveforms of a gate clock signal and a scanning signal between a first vertical scanning period and a second vertical scanning period in the first embodiment.

FIG. 1 is an enlarged view of a portion given reference character 81 in FIG. 10. Part A of FIG. 11 shows exemplary waveforms of a gate clock signal GCK and a scanning signal GL in the first vertical scanning period Ta, and Part B of FIG. 11 shows exemplary waveforms of a gate clock signal GCK and a scanning signal GL in the second vertical scanning period Tb. As can be grasped from FIGS. 1 and 11, the clock frequency of the gate clock signal GCK in the second vertical scanning period Tb is higher than the clock frequency of the gate clock signal GCK in the first vertical scanning period Ta, and the pulse width of the gate clock signal GCK in the second vertical scanning period Tb is narrower than the pulse width of the gate clock signal GCK in the first vertical scanning period Ta. Since the length of a period during which the scanning signal GL is maintained at a low level is a length determined based on the pulse width of the gate clock signal GCK, the length of a period during which the scanning signal GL is maintained at a low level in the first vertical scanning period Ta is longer than the length of a period during which the scanning signal GL is maintained at a low level in the second vertical scanning period Tb.

As described above, when the gate driver 300 applies an on-level (here, low level) scanning signal to any of the first scanning signal lines GL(1) to GL(8), the switches 202 in the connection control part 250 are turned on, and when the gate driver 300 applies an on-level scanning signal to any of the second scanning signal lines GL(9) to GL(16), the switches 252 in the connection control part 250 are turned off. Further, when a period during which an on-level scanning signal is applied to each of the first scanning signal lines so that data signals are written into pixel circuits 20 included in the first display region 210 is defined as "first writing period", and a period during which an on-level scanning signal is applied to each of the second scanning signal lines so that data signals are written into pixel circuits 20 included in the second display region 220 is defined as "second writing period", the gate driver 300 sets a second writing period TW2 shorter than a first writing period TW1 (see FIG. 11).

As can be grasped from FIGS. 1 and 10, the second vertical scanning period Tb is shorter than the first vertical scanning period Ta. To implement this, there is a need to relatively increase, in the first vertical scanning period Ta, intervals at which data signals are outputted from the source driver 500, and relatively reduce, in the second vertical scanning period Tb, intervals at which data signals are outputted from the source driver 500. Hence, for example, the configuration may be such that a RAM that can hold data for one screen or for several tens of lines is provided in the source driver 500, and timing at which the data held in the RAM is read and data signals are applied to the data signal lines is adjusted based on a source clock signal. Note that when a source driver 500 that does not include a RAM is adopted, for example, a line buffer that can hold data for several tens of lines may be provided.

Figure 12:
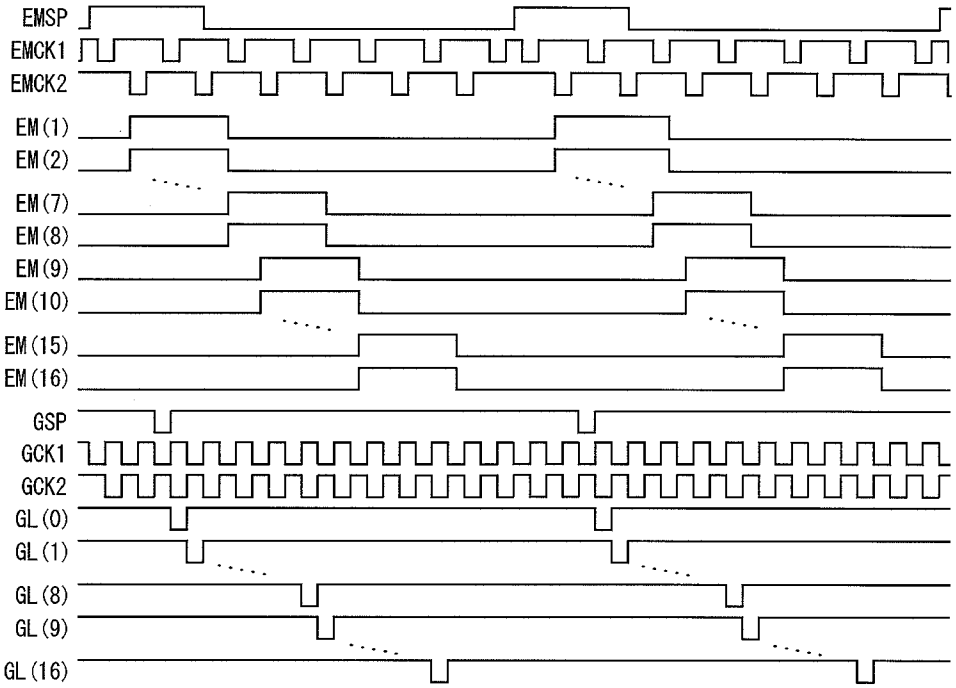
FIG. 12 is a signal waveform diagram of a known configuration.
Figure 13:
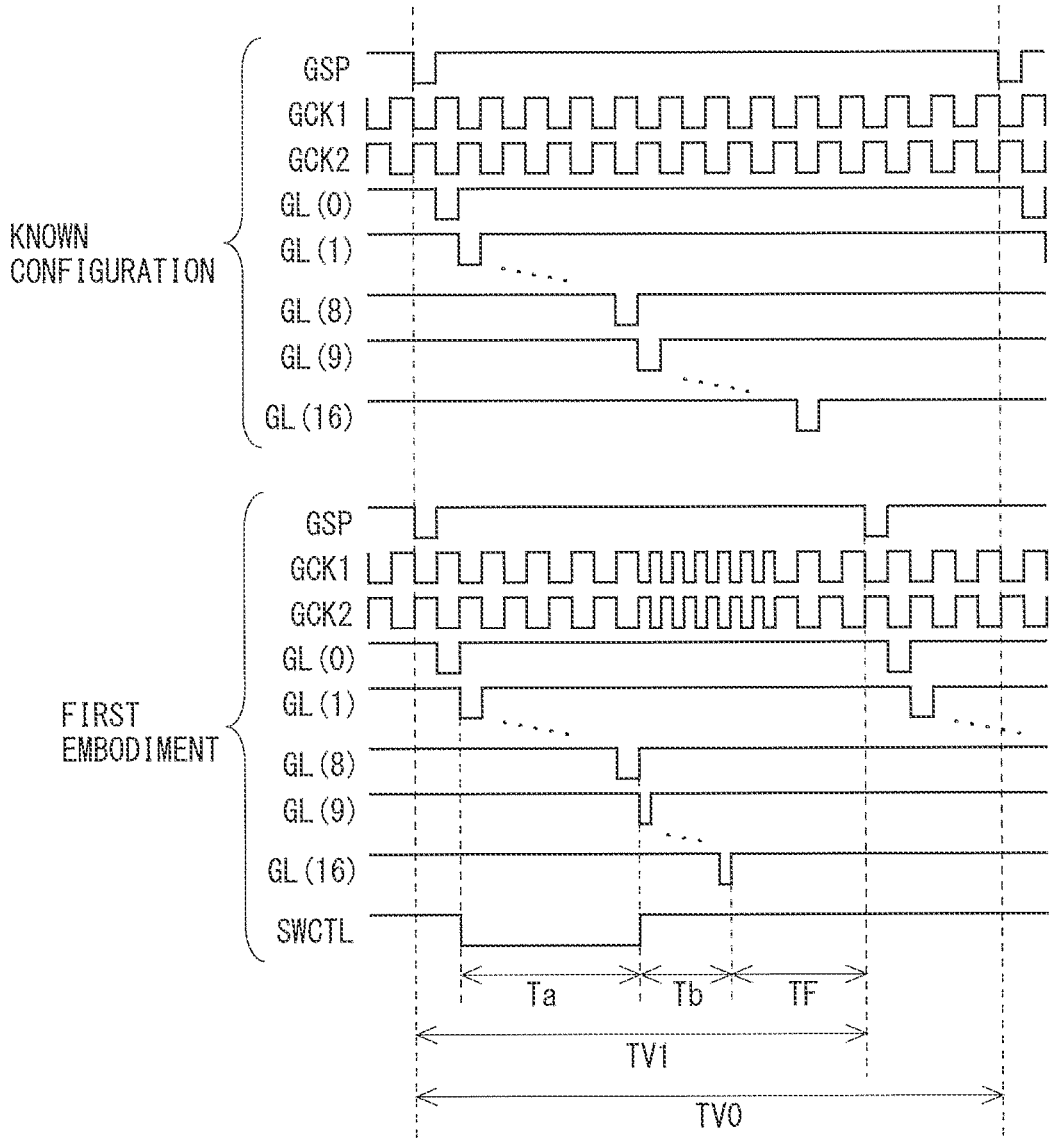
FIG. 13 is a signal waveform diagram for comparing a vertical period of the known configuration with a vertical period of the first embodiment.

Now, a difference between a vertical period of the known configuration and a vertical period of the present embodiment will be described. FIG. 12 is a signal waveform diagram for the known configuration (a configuration in which the connection control part 250 is not provided). FIG. 13 is a diagram for comparing a vertical period TV0 of the known configuration with a vertical period TV1 of the present embodiment.

As shown in FIG. 13, the vertical period TV1 of the present embodiment is shorter than the vertical period TV0 of the known configuration. In other words, the length of a vertical flyback period TF is set such that the vertical period TV1 of the present embodiment is shorter than the vertical period TV0 of the known configuration (i.e., a vertical period set when the second vertical scanning period Tb is assumed to have the same length as the first vertical scanning period Ta).

Figure 14:
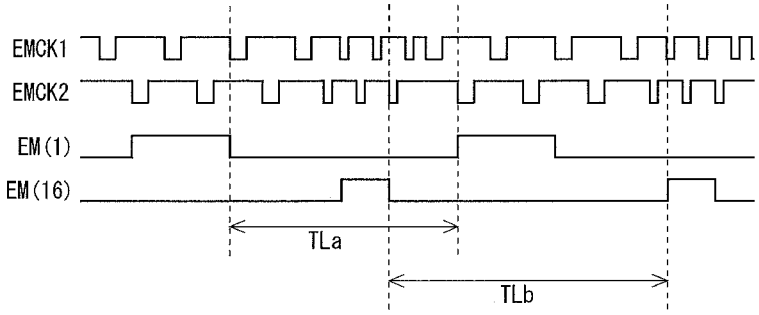
FIG. 14 is a signal waveform diagram for describing the fact that the length of a light emission period varies depending on the row in the first embodiment.

Meanwhile, according to the present embodiment, the length of a light emission period of the organic EL element 21 in the pixel circuit 20 varies depending on the row, which will be described below. As described above, in each pixel circuit 20, the organic EL element 21 emits light during a period from when the light emission control signal EM(p) is changed from the high level to the low level until when the light emission control signal EM(p) changes from the low level to the high level (see FIGS. 4 and 5). Thus, when the first row and the sixteenth row are taken a look at in the above-described example, for the first row, a period TLa of FIG. 14 is a light emission period, and for the sixteenth row, a period TLb of FIG. 14 is a light emission period. The period TLa Includes many periods with narrow pulse widths of emission clock signals EMCK1 and EMCK2, whereas the period TLb includes only a few periods with narrow pulse widths of the emission clock signals EMCK1 and EMCK2. Therefore, the light emission period TLa for the first row is shorter than the light emission period TLb for the sixteenth row. As such, the light emission periods of organic EL elements 21 in pixel circuits 20 included in the first display region 210 are shorter than the light emission periods of organic EL elements 21 in pixel circuits 20 included in the second display region 220. Such a difference in the length of the light emission period between the rows can cause a difference in luminance between a given row and another row. Hence, it is desirable to take measures to suppress occurrence of a difference in luminance caused by the difference in the length of the light emission period. Two exemplary measures (first exemplary measures and second exemplary measures) will be described below.

First, the first exemplary measures will be described. In this example, the voltage value of a data signal (the value of a voltage applied to a data signal line SL) is corrected so that in a pixel circuit 20 included in a row with a short light emission period, a large drive current compared with that of a pixel circuit 20 included in a row with a long light emission period flows through an organic EL element 21. Regarding this, the source driver 500 generates a data signal based on a digital video signal DV transmitted from the display control circuit 100. Accordingly, correction of the voltage value of the data signal is implemented by the display control circuit 100 correcting the value of the digital video signal DV.

Next, the second exemplary measures will be described. In this example, instead of driving the light emission control lines EM(1) to EM(M) by the emission driver 400 based on the emission start pulse signal EMSP and emission clock signals EMCK1 and EMCK2, the display control circuit 100 directly provides light emission control signals to all light emission control lines EM(1) to EM5M). Regarding this, the display control circuit 100 allows the light emission control signals to be maintained at a low level for a period of the same length in all light emission control lines EM(1) to EM(M). By this, the light emission periods for all rows have the same length. Note, however, that in this example, there are required M signal lines (signal lines through which light emission control signals are transmitted) that connect the display control circuit 100 to each of the light emission control lines EM(1) to EM(M) in the display unit 200. Thus, this example is not suitable for a high-resolution display device.

<1.6 Effects>

According to the present embodiment, in an organic EL display device, in the display unit 200 there are provided the first display region 210 and the second display region 220 which are two display regions, and there are provided the switches 252 for controlling states of electrical connection between data signal lines disposed in the first display region 210 (the first data signal lines SLa) and data signal lines disposed in the second display region 220 (the second data signal lines SLb) The on/off of the switches 252 is controlled by a switch control signal SWCTL transmitted from the display control circuit 100. When data signals are written into pixel circuits 20 included in the first display region 210, the switches 2S2 are turned on, and when data signals are written into pixel circuits 20 included in the second display region 220, the switches 252 are turned off. Meanwhile, in general, power consumption required to charge and discharge data signal lines is proportional to the product of drive frequency, loads (wiring loads) on the data signal lines, the voltage amplitudes of data signals, and the number of the data signal lines. When data signals are written into pixel circuits 20 included in the first display region 210, due to the provision of the switches 252, a wiring load on each data signal line is larger than that of the original configuration. However, when data signals are written into pixel circuits 20 included in the second display region 220, the first data signal lines SLa and the second data signal lines SLb are in an electrically disconnected state, and thus, a wiring load on each data signal line is smaller than that of the original configuration. Power consumption reduced thereby is larger than power consumption that increases with the increase in wiring loads upon writing of data signals into the pixel circuits 20 included in the first display region 210. Thus, power consumption as a whole is reduced compared with that of the known configuration. In addition, when data signals are written into the pixel circuits 20 included in the second display region 220, a wiring load on each data signal line is smaller than that of the original configuration, and thus, a data signal writing period can be reduced to the extent that problems concerning display do not occur. Hence, in the present embodiment, as described above, a second writing period (a data writing period in a second vertical scanning period Tb) TW2 is shorter than a first writing period (a data writing period in a first vertical scanning period Ta) TW1. As a result, drive time per scanning signal line is shorter than that of the known configuration. As above, according to the present embodiment, a display device is implemented that can reduce drive time per scanning signal line compared to the known configuration while reducing power consumption.

In addition, by the reduction in power consumption, the following effects are expected. First, miniaturization of the source driver 500 which is implemented by an LSI, etc., and cost reduction associated therewith are expected. Moreover, in mobile phones, etc., usable hours after charging are extended. Furthermore, since it becomes possible to miniaturize a battery used in a device, flexibility in the design of the device improves, and implementation of appealing designs is expected. Moreover, radiation noise iron a display device is reduced. Furthermore, since it becomes possible to maintain drive voltage at a high level, extension of a dynamic range or an increase in the amplitudes of gate control signals GCTL can be achieved.

2. Second Embodiment

A second embodiment will be described. Note, however, that the following mainly describes differences from the first embodiment.

<2.1 Summary>

A functional configuration of an organic EL display device, a configuration of the display unit 200, a configuration of the pixel circuits 20, and control of the switches 252 in the connection control part 250 are the same as those of the above-described first embodiment. In the first embodiment, a vertical period is short compared with that of the known configuration. On the other hand, a vertical period of the present embodiment has the same length as the vertical period of the known configuration. A drive method of the present embodiment will be described below.

<2.2 Drive Method for the Organic EL Panel>

Figure 15:
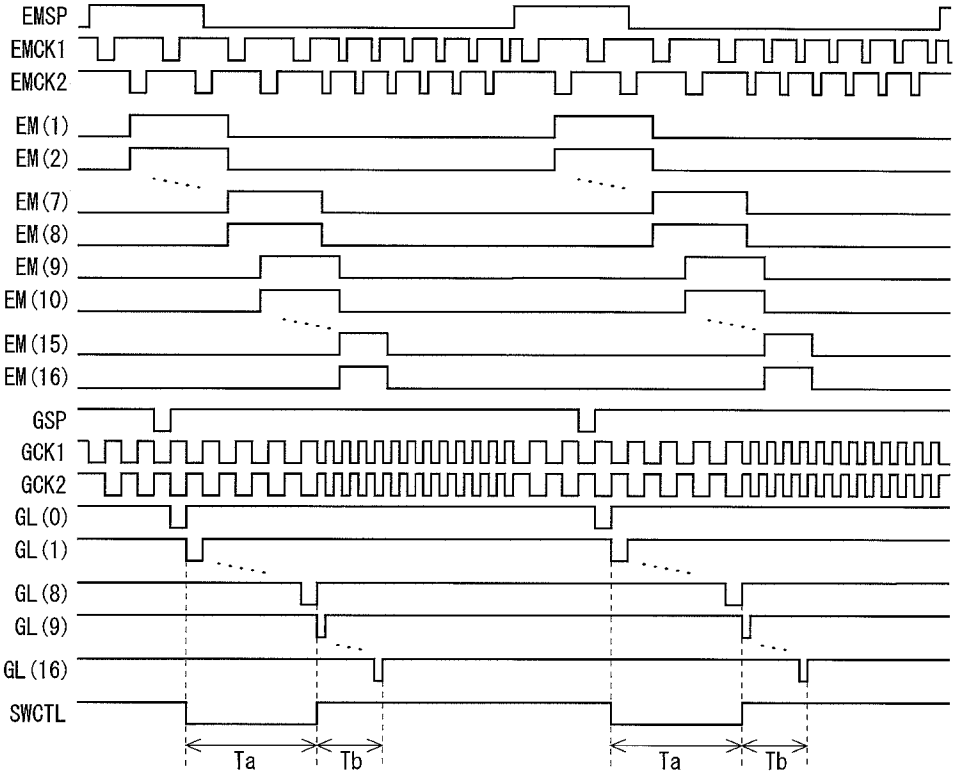
FIG. 15 is a signal waveform diagram for describing a drive method of a second embodiment.

FIG. 15 is a signal waveform diagram for describing a drive method of the present embodiment. As in the first embodiment, during a first vertical scanning period Ta, scanning signals GL(1) to GL(8) sequentially go to a low level for a predetermined period with the switches 252 in the connection control part 250 being turned on, and during a second vertical scanning period Tb, scanning signals GL(9) to GL(16) sequentially go to a low level for a predetermined period with the switches 252 in the connection control part 250 being turned off. As in the first embodiment, a second writing period (a period during which an on-level scanning signal is applied to each of the second scanning signal lines) TW2 is shorter than a first writing period (a period during which an on-level scanning signal is applied to each of the first scanning signal lines) TW1 (see FIG. 11).

Figure 16:
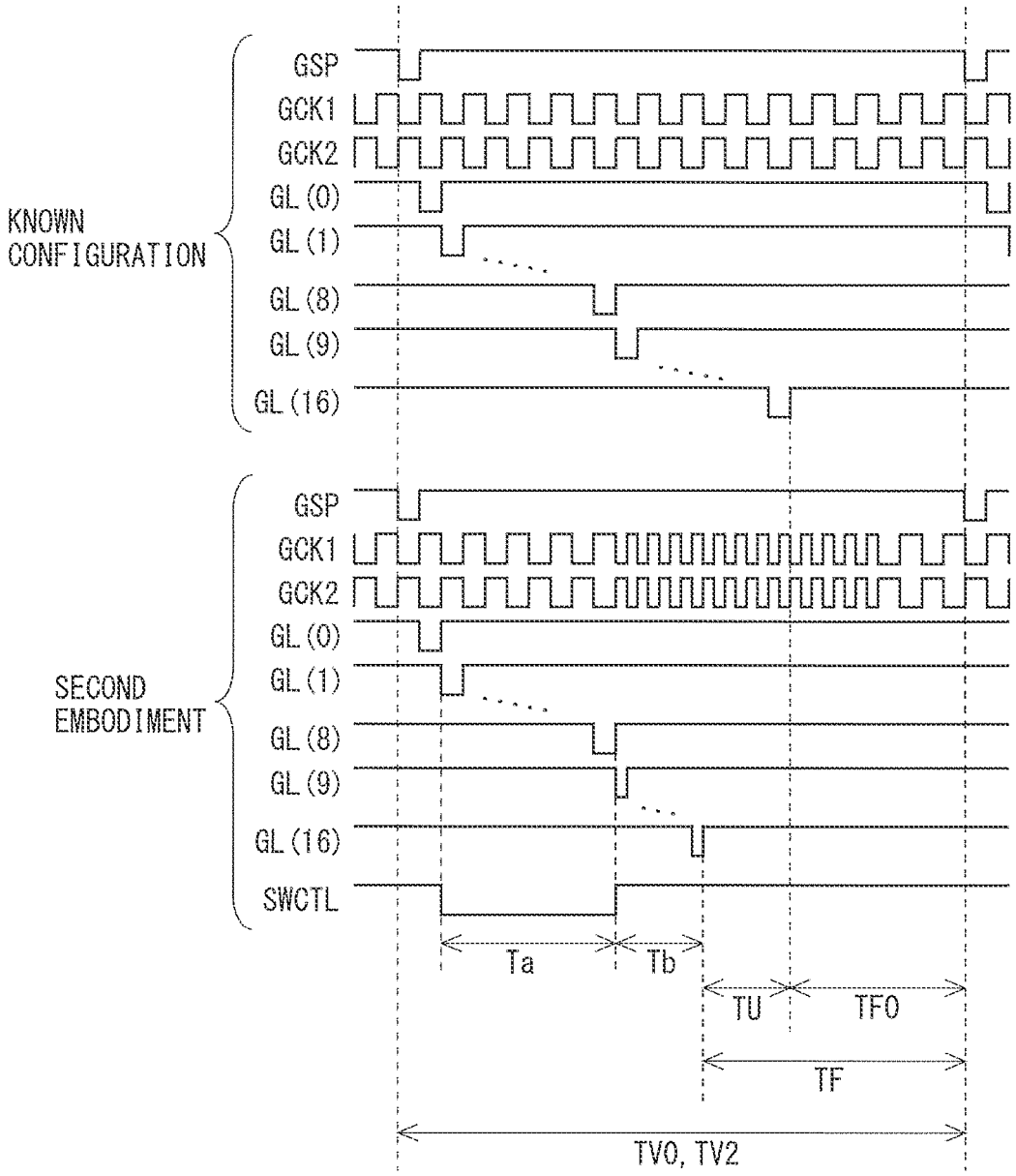
FIG. 16 is a diagram for comparing a vertical period of the second embodiment with the vertical period of the known configuration.

FIG. 16 is a diagram for comparing the vertical period TVO of the known configuration with a vertical period TV2 of the present embodiment. As described above, the vertical period TV2 of the present embodiment has the same length as the vertical period TVO of the known configuration. In other words, the length of a vertical flyback period TF is set such that the vertical period TV2 of the present embodiment has the same length as the vertical period TVO of the known configuration (i.e., a vertical period set when the second vertical scanning period Tb is assumed to have the same length as the first vertical scanning period Ta).

As can be grasped from FIG. 16, the vertical flyback period TF of the present embodiment is longer by a period TU than a vertical flyback period TFO of the known configuration. Thus, the period TU can be used for a process other than drive operation for display.

<2.3 Effects>

According to the present embodiment, as in the first embodiment, a display device is implemented that can reduce drive time per scanning signal line compared to the known configuration while reducing power consumption. In addition, the vertical flyback period TF is long compared with that of the known configuration (see FIG. 16). Thus, for example, when this organic EL display device includes a touch panel, a process for touch detection can be performed during the period TU. During the vertical flyback period TF, since drive operation for display is not performed, noise occurring in a surface of the organic EL panel 6 is remarkably small. Therefore, by performing a process for touch detection during the vertical flyback period TF including the period TU, the accuracy of the touch detection can be increased. As such, a process other than drive operation for display can be performed more accurately than the known configuration.

3. Third Embodiment

<3.1 Summary>

A functional configuration of an organic EL display device, a configuration of the display unit 200, a configuration of the pixel circuits 20, and control of the switches 252 in the connection control part 250 are the same as those of the above-described first embodiment. In the first embodiment, a second vertical scanning period Tb is shorter than a first vertical scanning period Ta. On the other hand, in the present embodiment, a second vertical scanning period Tb has the same length as a first vertical scanning period Ta. Further, in the first embodiment, a vertical period is short compared with that of the known configuration. On the other hand, as in the second embodiment, a vertical period of the present embodiment has the same length as the vertical period of the known configuration. A drive method of the present embodiment will be described below.

<3.2 Drive Method for the Organic EL Panel>

Figure 17:
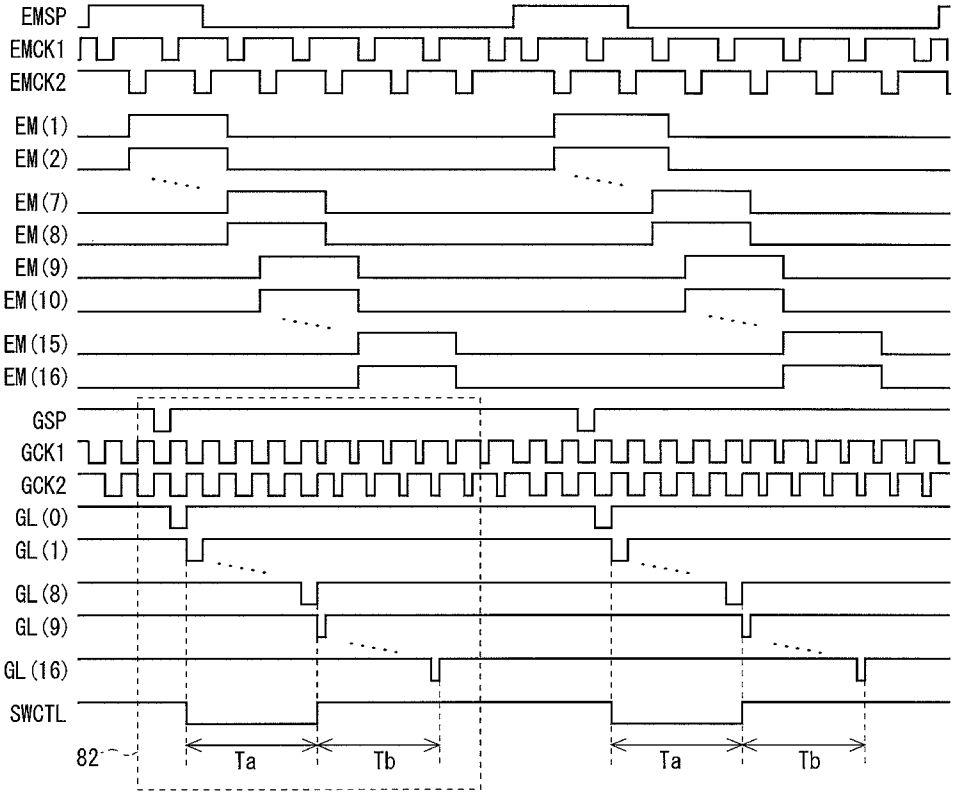
FIG. 17 is a signal waveform diagram for describing a drive method of a third embodiment.
Figure 18:
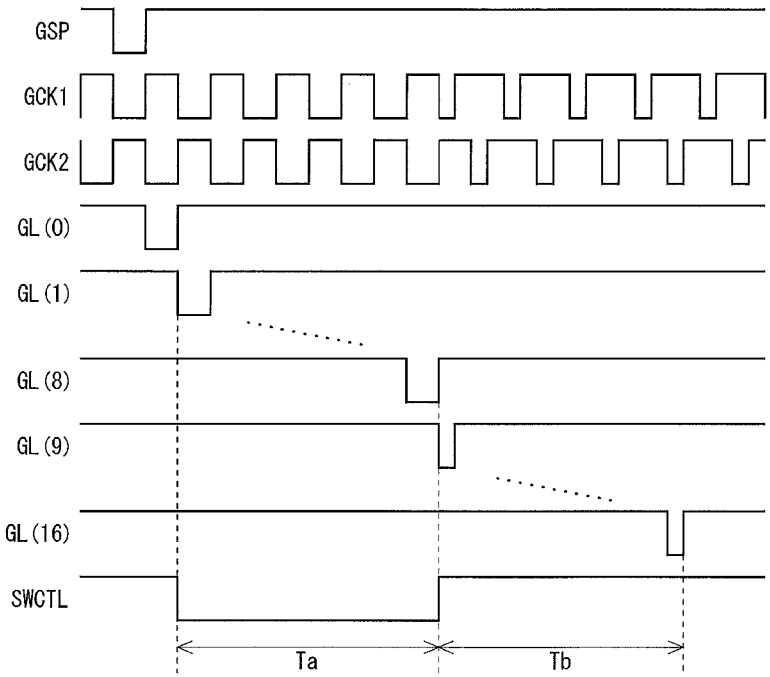
FIG. 18 is a signal waveform diagram for an effective vertical scanning period of the third embodiment.
Figure 19:
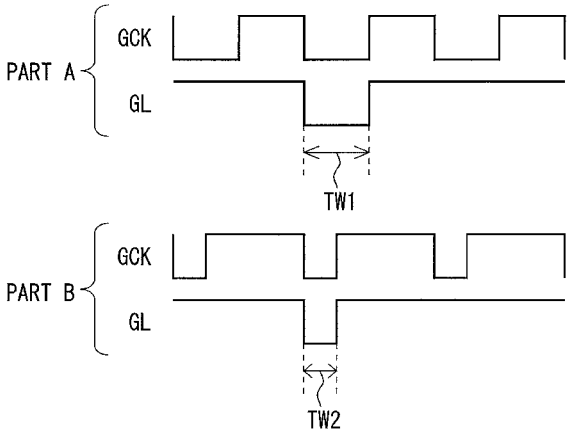
FIG. 19 is a signal waveform diagram for describing differences in the waveforms of a gate clock signal and a scanning signal between a first vertical scanning period and a second vertical scanning period in the third embodiment.

FIG. 17 is a signal waveform diagram for describing a drive method of the present embodiment. FIG. 18 is an enlarged view of a portion given reference character 82 in FIG. 17. Part A of FIG. 19 shows exemplary waveforms of a gate clock signal GCK and a scanning signal GL in the first vertical scanning period Ta, and part B of FIG. 19 shows exemplary waveforms of a gate clock signal GCK and a scanning signal GL in the second vertical scanning period Tb. As in the first embodiment, during the first vertical scanning period Ta, scanning signals GL(1) to GL(8) sequentially go to a low level for a predetermined period with the switches 252 in the connection control part 250 being turned on, and during the second vertical scanning period Tb, scanning signals GL(9) to GL(16) sequentially go to a low level for a predetermined period with the switches 252 in the connection control part 250 being turned off. In addition, as in the first embodiment, a second writing period (a period during which an on-level scanning signal is applied to each of the second scanning signal lines) TW2 is shorter than a first writing period ta period during which an on-level scanning signal is applied to each of the first scanning signal lines) TW1 (see FIG. 19).

Figure 20:
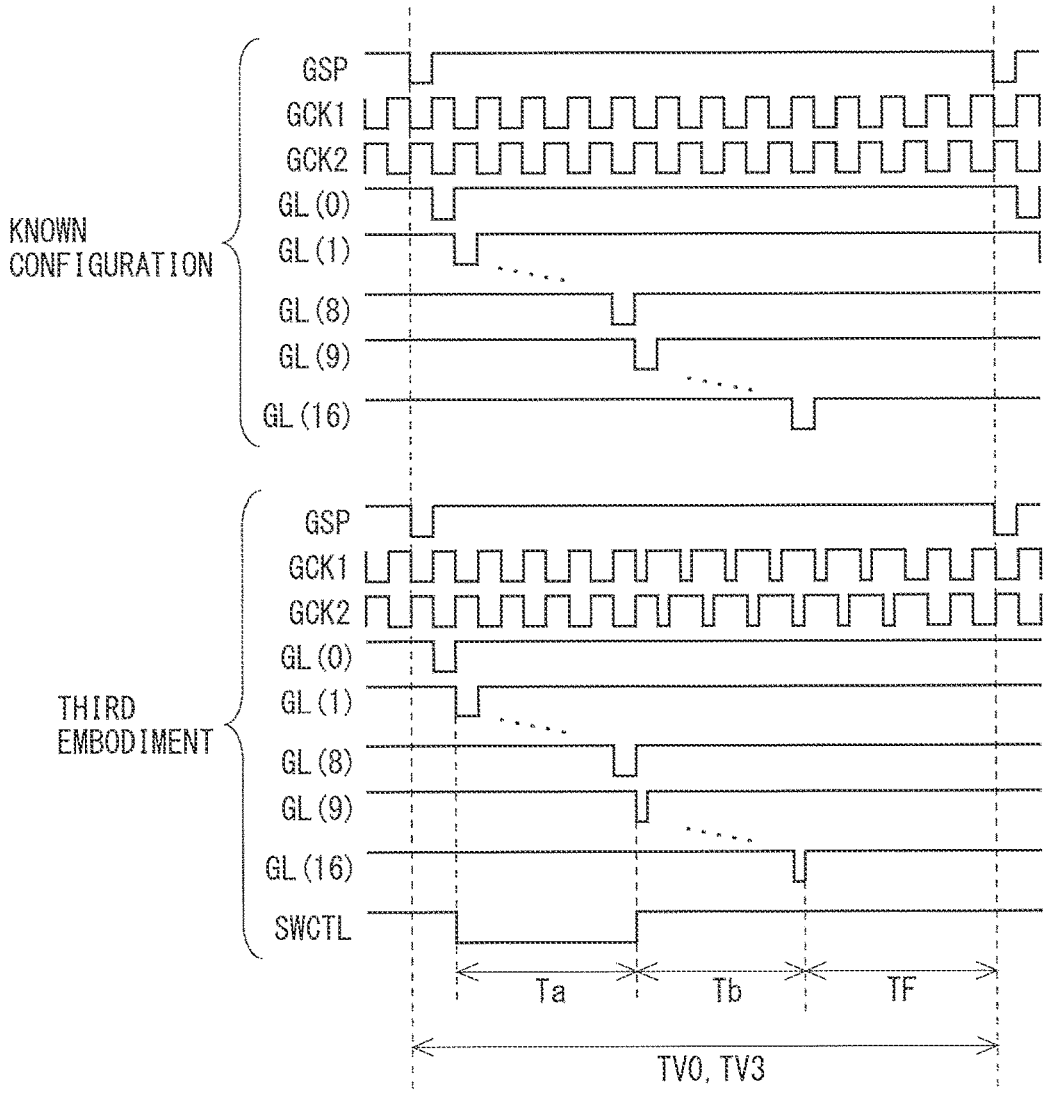
FIG. 20 is a diagram for comparing a vertical period of the third embodiment with the vertical period of the known configuration.

Meanwhile, as shown in FIG. 19, in the present embodiment, regarding the gate clock signal GCK, in the first vertical scanning period Ta, a period during which the high level is maintained has the sane length as a period during which the low level is maintained (see part A), but in the second vertical scanning period Tb, a period during which the low level is maintained is shorter than a period during which the high level is maintained (see part B). As such, the duty ratio of the gate clock signal GCK in the first vertical scanning period Ta differs from the duty ratio of the gate clock signal GCK in the second vertical scanning period Tb. The clock cycle of the gate clock signal GCK is the same between the first vertical scanning period Ta and the second vertical scanning period Tb. Since the waveform of the gate clock signal GCK changes in this manner, although the second writing period is shorter than the first writing period, the second vertical scanning period Tb has substantially the same length as the first vertical scanning period Ta. Therefore, by provision of a vertical flyback period TF having substantially the same length as that of the known configuration, as described above, a vertical period TV3 of the present embodiment has the same length as the vertical period TVO of the known configuration (see FIG. 20).

<3.3 Effects>

Figure 21:
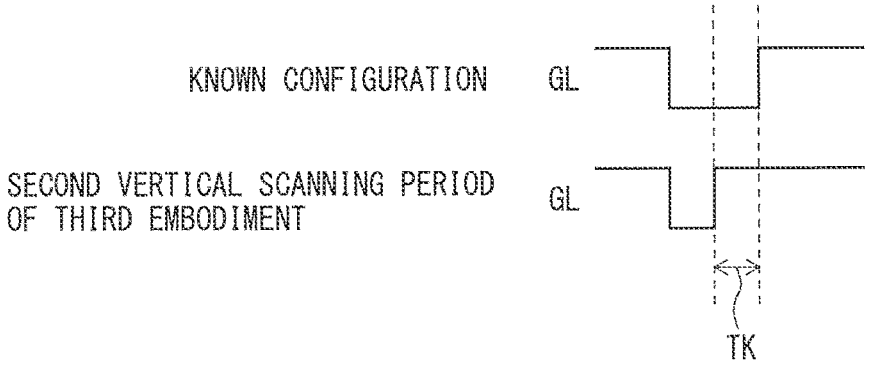
FIG. 21 is a signal waveform diagram for describing the length of a horizontal flyback period in the third embodiment.

According to the present embodiment, as in the first embodiment, a display device is implemented that can reduce drive time per scanning signal line compared to the known configuration while reducing power consumption. In addition, the second writing period TW2 is shorter than the first writing period TW1, and the first writing period TW1 has the same length as the data writing period of the known configuration. That is, the second writing period TW2 is shorter than the data writing period of the known configuration. Thus, the length of a horizontal flyback period in the second vertical scanning period Tb is longer by a period TK of FIG. 21 than a horizontal flyback period of the known configuration. By this, for example, a process other than drive operation for display can be performed during the horizontal flyback period in the second vertical scanning period Tb.

4. Fourth Embodiment

<4.1 Summary>

In the above-described first to third embodiments, a wiring load on the switching signal line SWL (see FIG. 3) is assumed to be relatively small, and the second vertical scanning period Tb starts immediately after the first vertical scanning period Ta ends. On the other hand, in the present embodiment, a transition period is provided between the first vertical scanning period Ta and the second vertical scanning period Tb for the following reason. During the second vertical scanning period Tb, a switch control signal SWCTL needs to be at a high level so that the switches 252 in the connection control part 250 go into an off state. However, when the wiring load on the switching signal line SWL is large, there is a possibility that the switch control signal SWCTL does not promptly change from a low level to a high level after the second vertical scanning period Tb starts. In this case, for example, in a case shown in FIG. 18, writing of data signals into pixel circuits 20 in the ninth row is performed with wiring loads on the data signal lines SL being large. As a result, insufficient charging can occur. Hence, in order that the switch control signal SWCTL is at the high level (in order that the switches 252 are in the off state) at the time of start of the second vertical scanning period Tb, the transition period is provided. Note that in each vertical period, the first vertical scanning period Ta may appear earlier than the second vertical scanning period Tb, or the second vertical scanning period Tb may appear earlier than the first vertical scanning period Ta. That is, the transition period for changing the level of the switch control signal SWCTL so as to change on/off of the switches 252 is provided between the time of end of a period that appears earlier out of the first vertical scanning period Ta and the second vertical scanning period Tb and the time of start of a period that appears later. Note that in the following, description will be made using, as an example, a case in which the waveforms of gate clock signals GCK1 and GCK2 change in the same manner as in the third embodiment.

<4.2 Drive Method for an Organic EL Panel>

Figure 22:
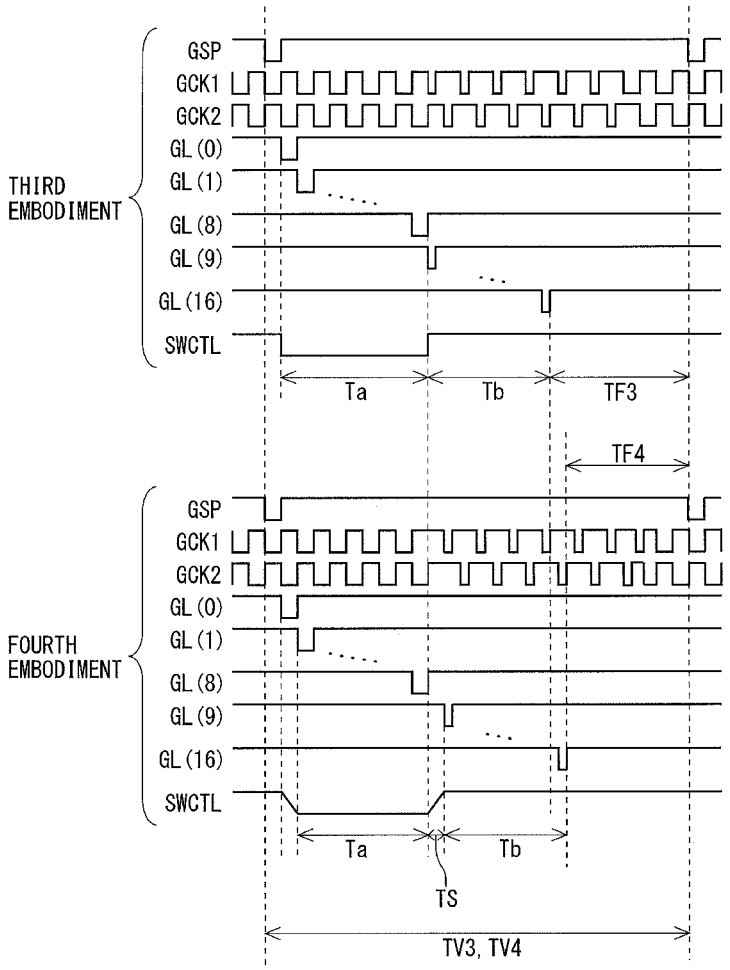
FIG. 22 is a diagram showing, by comparison, signal waveforms of a fourth embodiment and signal waveforms of the third embodiment.

FIG. 22 is a diagram showing, by comparison, signal waveforms of the present embodiment and signal waveforms of the above-described third embodiment. In the present embodiment, too, during a first vertical scanning period Ta, scanning signals GL(1) to GL(8) sequentially go to a low level for a predetermined period with the switches 252 in the connection control part 250 being turned on, and during a second vertical scanning period Tb, scanning signals GL(9) to GL(16) sequentially go to a low level for a predetermined period with the switches 252 in the connection control part 250 being turned off.

Here, as shown in FIG. 22, a transition period TS whose length corresponds to one horizontal scanning period Is provided between the time of end of the first vertical scanning period Ta and the time of start of the second vertical scanning period Tb. During the transition period TS, the switch control signal SWCTL changes from the low level to the high level. Mote that the transition period TS is implemented by adjusting the waveforms of gate clock signals GCK1 and GCK2 so that the scanning signal GL(9) does not fall immediately after the end of the first vertical scanning period Ta.

Meanwhile, by the provision of the transition period TS whose length corresponds to one horizontal scanning period, compared with a case in which the transition period TS is not provided, scanning timing of each of the second scanning signal lines GL(9) to GL(16) (timing at which each scanning signal changes from a high level to a low level) and output timing of data signals for each row from the source driver 500 in the second vertical scanning period Tfc are shifted by one horizontal scanning period. Hence, in the present embodiment, a vertical flyback period is short compared with that in a case in which the transition period TS is not provided. Thus, as shown in FIG. 22, the vertical flyback period TF4 of the present embodiment is shorter than the vertical flyback period TF3 of the third embodiment. By this, the vertical period TV4 of the present embodiment has the same length as the vertical period TV3 of the third embodiment. That is, frame frequency is the same between the present embodiment and the third embodiment.

Note that the length of the transition period TS is not limited to a length corresponding to one horizontal scanning period, and any transition period TS may be provided as long as the transition period TS has a sufficient length for changing on/off of the switches 252 in the connection control part 250.

(4.3 Effects)

According to the present embodiment, a display device is implemented that can reduce drive time per scanning signal line compared to the known configuration while reducing power consumption, without causing a display failure resulting from insufficient charging, etc., even in a case in which a wiring load on the switching signal line SWL is large.

5. Fifth Embodiment

<5.1 Summary>

Figure 23:
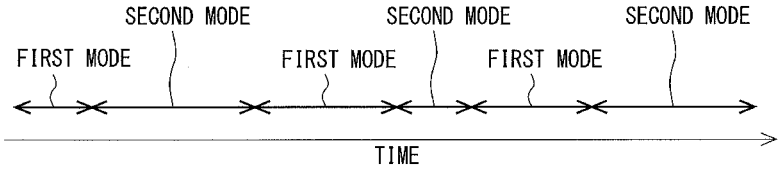
FIG. 23 is a diagram for describing switching between a first mode and a second mode in a fifth embodiment.

A functional configuration of an organic EL display device, a configuration of the display unit 200, a configuration of the pixel circuits 20, and control of the switches 252 in the connection control part 250 are the same as those of the above-described first embodiment. In the organic EL display device according to the present embodiment, as display modes, there are prepared a first node (low-speed mode) in which drive frequency is a first frequency, and a second mode (high-speed mode) in which drive frequency is a second frequency higher than the first frequency. As shown in FIG. 23, switching between the first mode and the second mode is performed at optional timing. In the second mode, as in the above-described first to fourth embodiments, a second writing period TW2 is shorter than a first writing period TW1. On the other hand, in the first mode, the second writing period TW2 has the same length as the first writing period TW1. In addition, for example, in the first mode, a first vertical scanning period Ta has the same length as a second vertical scanning period Tb, and in the second mode, the second vertical scanning period Tb is shorter than the first vertical scanning period Ta.

In both the first mode and the second mode, during the first vertical scanning period (a period during which writing of data signals into pixel circuits 20 included in the first display region 210 is performed) Ta, a switch control signal SWCTL is maintained at a low level, by which the switches 252 in the connection control part 250 are maintained in an on state, and during the second vertical scanning period (a period during which writing of data signals into pixel circuits 20 included in the second display region 220 is performed) Tb, the switch control signal SWCTL is maintained at a high level, by which the switches 252 in the connection control part 250 are maintained in an off state. Thus, in both the first mode and the second mode, during the second vertical scanning period Tb, writing of data signals into the pixel circuits 20 is performed with wiring loads on the data signal lines SL being smaller than those of the original configuration (the known configuration in which the switches 252 are not provided).

When the wiring loads are smaller than those of the original configuration, the length of a writing period can be reduced compared to the original configuration. However, as described above, in the first mode, the second writing period TW2 has the same length (i.e., the original length) as the first writing period TW1. This fact can cause a difference between a charging rate for the first display region 210 and a charging rate for the second display region 220 in the first mode. Hence, in the present embodiment, in the first node, bias currents of output amplifiers in the source driver 500 are adjusted. Specifically, in the first mode, in the second vertical scanning period Tb, the bias currents are reduced compared with those in the first vertical scanning period Ta.

<5.2 For Components Related to the Adjustment to the Bias Currents>

Figure 24:
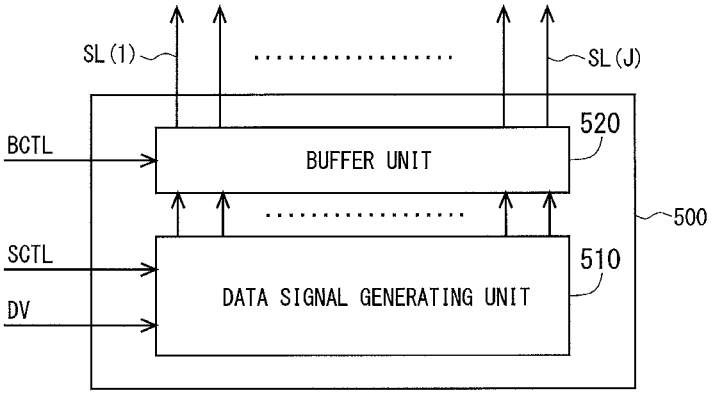
FIG. 24 is a schematic configuration diagram of a source driver of the fifth embodiment.

Components related to the adjustment to the bias currents will be described below. FIG. 24 is a schematic configuration diagram of the source driver 500. As shown in FIG. 24, the source driver 500 is composed of a data signal generating unit 510 and a buffer unit 520. The data signal generating unit 510 generates data signals based on digital video signals DV and a source control signal SCTL. The buffer unit 520 includes output amplifiers provided for the respective data signal lines SL, and applies the data signals to the respective data signal lines SL. The output amplifiers in the buffer unit 520 perform impedance transformation on voltages which are the data signals generated by the data signal generating unit 510, and apply the transformed voltages to the source bus lines SL.

Figure 25:
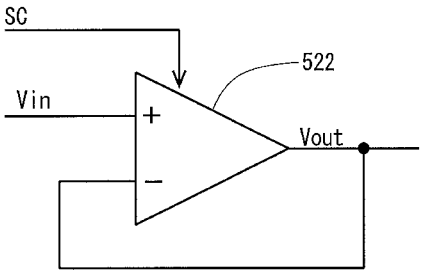
FIG. 25 is a diagram showing a configuration of an output amplifier provided for one source bus line in the fifth embodiment.

Next, a configuration of an output amplifier provided for one source bus line SL will be described. As shown in FIG. 25, the output amplifier includes an operational amplifier 522. A voltage (gradation voltage) Vin outputted from the data signal generating unit 510 is provided to a non-inverting input terminal of the operational amplifier 522. An output from the operational amplifier 522 is provided to an inverting input terminal of the operational amplifier 522. That is, negative feedback is applied to the operational amplifier 522. An output Vout from the operational amplifier 522 is provided as a data signal to the source bus line SL. As above, the output amplifier of the present embodiment is a voltage follower circuit.

Figure 26:
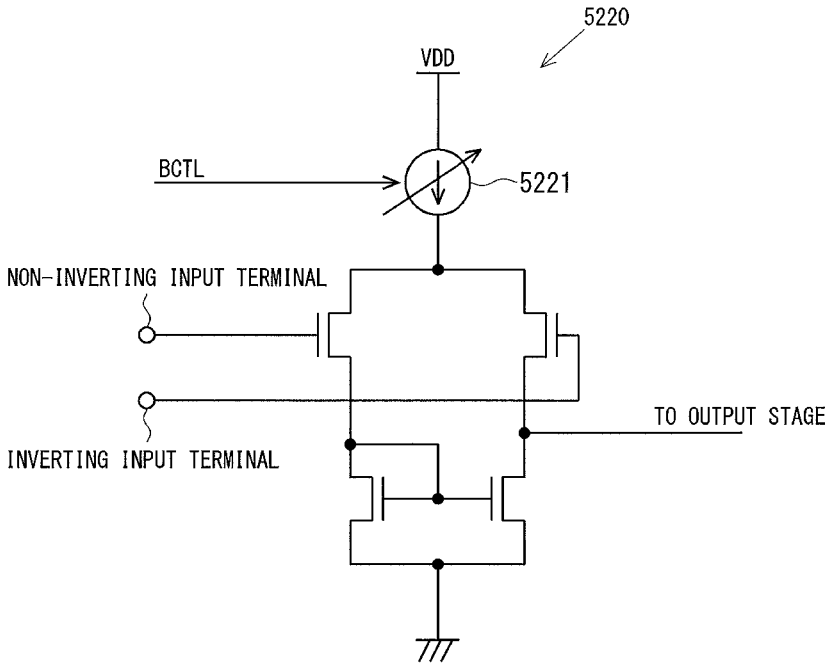
FIG. 26 is a diagram showing an exemplary configuration of a differential amplifier included in an operational amplifier in the fifth embodiment.

The operational amplifier 522 includes, for example, a differential amplifier 5220 having a configuration such as that shown in FIG. 26. The differential amplifier 5220 includes a variable constant current source 5221 that can control the magnitude of a constant current flowing through the circuit. The magnitude of a constant current supplied into the circuit by the variable constant current source 5221 is controlled by, for example, a bias current control signal BCTL transmitted from the display control circuit 100. By thus controlling the magnitude of a constant current flowing through the differential amplifier 5220, the magnitude of a bias current of the output amplifier changes.

<5.3 Effects>

According to the present embodiment, in the second mode (high-speed mode), the same driving as that of any of the first to fourth embodiments is performed. Hence, in the second mode, while power consumption is reduced, drive time per scanning signal line can be reduced cox-cared to the known configuration. In addition, in the first mode (low-speed mode), in the second vertical scanning period Tb, the magnitude of bias currents of the output amplifiers in the source driver 500 is reduced over that in the first vertical scanning period Ta. Hence, in the first node, too, power consumption is reduced compared to the known configuration.

6. Variant

Although two display regions (the first display region 210 and the second display region 220) are provided in the display unit 200 in each of the above-described embodiments, the configuration is not limited thereto, and three or more display regions may be provided in the display unit 200. An example in which three display regions (the first display region 210, the second display region 220, and a third display region 230) are provided in the display unit 200 will be described below as a variant.

Figure 27:
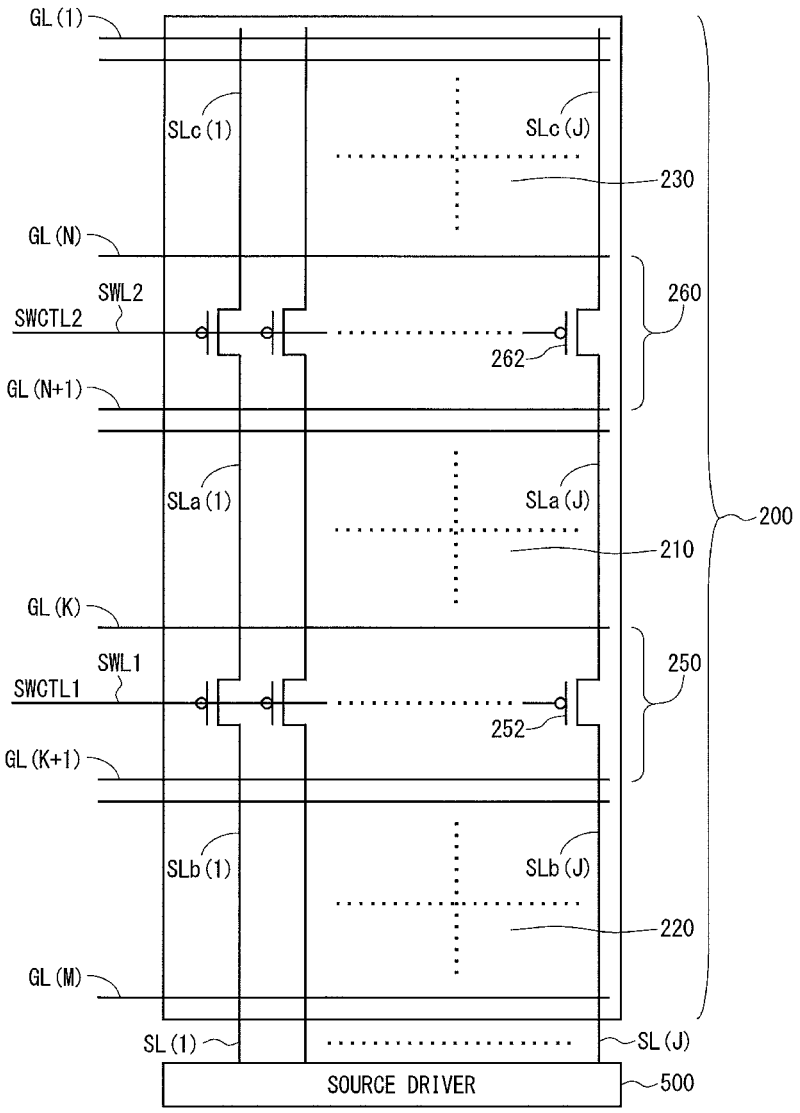
FIG. 27 is a diagram for describing a configuration of a display unit of a variant.

FIG. 27 is a diagram for describing a configuration of the display unit 200 of the present variant. As described above, in the present variant, the third display region 230 is provided in the display unit 200, in addition to the first display region 210 and the second display region 220. Different images can be displayed in the first display region 210, the second display region 220, and the third display region 230. The third display region 230 is provided on the opposite side to the second display region 220 with respect to the first display region 210. Mote that data signal lines disposed in the third display region 230 are referred to as "third data signal lines", and scanning signal lines disposed in the third display region 230 are referred to as "third scanning signal lines".

As in the above-described first embodiment, the connection control part 250 is provided between the second display region 220 and the first display region 210, and the switches 252 for controlling states of electrical connection between the second data signal lines SLb and the first data signal lines SLa are provided in the connection control part 250. Note that in the present variant, the connection control part 250 is referred to as "first connection control part", a signal that controls on/off of the switches 252 is referred to as "first switch control signal", and a signal line through which the first switch control signal is transmitted is referred to as "first switching signal line".

In addition, as shown in FIG. 27, a second connection control part 260 is provided between the first display region 210 and the third display region 230. In the second connection control part 260 there is disposed a second switching signal line SWL2 extending in parallel to the M scanning signal lines GL(1) to GL(M) so as to intersect the J data signal lines SL(1) to SL(J). Furthermore, the second connection control part 260 includes J switches (analog switches) 262 provided at intersecting portions of the J data signal lines SL(1) to SL(J) and the second switching signal line SWL2. The first data signal lines SLa(1) to SLa(J) and third data signal lines SLc(1) to SLc(J) are connected to each other through their corresponding switches 262. The second switching signal line SWL2 transmits a second switch control signal SWCTL2 that controls on/off of the J switches 262. Each switch 262 is connected at its control terminal to the second switching signal line SWL2, connected at its first conductive terminal to a corresponding third data signal line SLc through a contact hole. and connected at its second conductive terminal to a corresponding first data signal line SLa through a contact hole. By such a configuration, the switch 262 functions to control a state of electrical connection between the third data signal line SLc and the first data signal line SLa. Note that in the present variant, the first switching element is implemented by the switch 252, and the second switching element is implemented by the switch 262.

Figure 28:
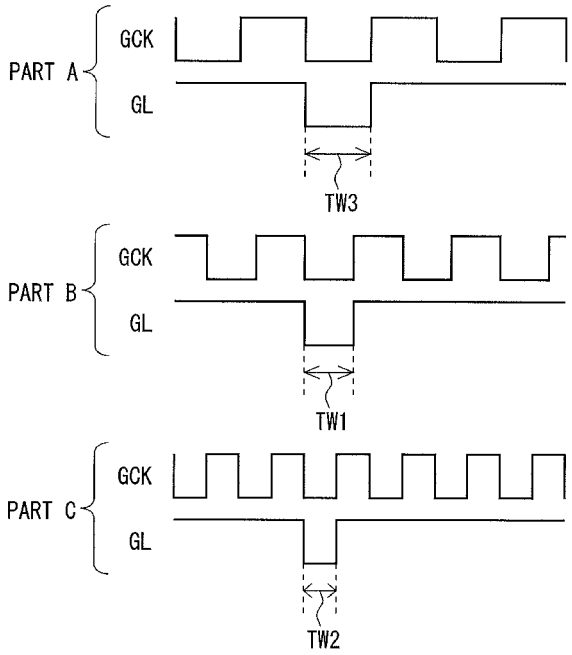

In the present variant, in an effective vertical scanning period, each period appears in the order of "a third vertical scanning period (a period during which writing of data signals into pixel circuits 20 included in the third display region 230 is performed by sequentially applying an on-level scanning signal to the plurality of third scanning signal lines) Tc, a first vertical scanning period Ta, and a second vertical scanning period Tb". Part A of FIG. 28 shows exemplary waveforms of a gate clock signal GCK and a scanning signal GL in the third vertical scanning period Tc, part B of FIG. 28 shows exemplary waveforms of a gate clock signal GCK and a scanning signal GL in the first vertical scanning period Ta, and part C of FIG. 28 shows exemplary waveforms of a gate clock signal GCK and a scanning signal GL in the second vertical scanning period Tb. When a period during which an on-level scanning signal is applied to each of the third scanning signal lines so that data signals are written into pixel circuits 20 included in the third display region 230 is defined as "third writing period", as shown in FIG. 28, the gate driver 300 sets a first writing period TW1 shorter than the third writing period TW3, and sets a second writing period TW2 shorter than the first writing period TW1.

Figure 29:
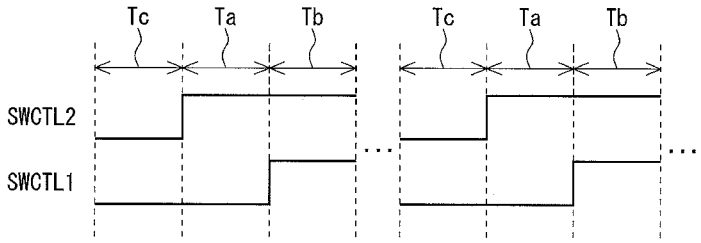
FIG. 29 is a signal waveform diagram for describing on/off control of switches provided in a first connection control part and a second connection control part in the variant.

Under presumption such as that described above, as shown in FIG. 29, during the third vertical scanning period tc, the first switch control signal SWCTL1 is at a low level and the second switch control signal SWCTL2 is at a low level. Hence, the switches 252 are in an on state and the switches 262 are in an on state. By this, the second data signal lines SLb, the first data signal lines SLa, and the third data signal lines SLc go into an electrically connected state, and data signals are supplied to the third data signal lines SLc from the source driver 500 through the second data signal lines SLb and the first data signal lines SLa.

Moreover, during the first vertical scanning period Ta, the first switch control signal SWCTL1 is at a low level and the second switch control signal SWCTL2 is at a high level. Hence, the switches 252 are in an on state and the switches 262 are in an off state. By this, the second data signal lines SLb and the first data signal lines SLa are electrically connected to each other, and the first data signal lines SLa and the third data signal lines SLc go into an electrically disconnected state. As a result, data signals are supplied to the first data signal lines SLa from the source driver 500 through the second data signal lines SLb, with wiring loads on the data signal lines SL being smaller than those of the original configuration.

Furthermore, during the second vertical scanning period Tb, the first switch control signal SWCTL1 is at a high level and the second switch control signal SWCTL2 is at a high level. Hence, the switches 252 are in an off state and the switches 262 are in an off state. By this, the second data signal lines SLb are electrically disconnected from the first data signal lines SLa and the third data signal lines SLc, remarkably reducing wiring loads on the data signal lines SL over those of the original configuration. With the wiring loads on the data signal lines SL being thus remarkably reduced over those of the original configuration, data signals are supplied to the second data signal lines SLb from the source driver 500.

As above, in the present variant, too, a display device is implemented that can reduce drive time per scanning signal line compared to the known configuration while reducing power consumption.

7. Others

Although description is made using an organic EL display device as an example in each of the above-described embodiments and the above-described variant, the configuration is not limited thereto, and the present disclosure can also be applied to liquid crystal display devices, inorganic EL display devices, QLED display devices, etc. In addition, the present disclosure can also be applied to display devices used for virtual reality (VR).

DESCRIPTION OF REFERENCE CHARACTERS

6: ORGANIC EL DISPLAY PANEL
20: PIXEL CIRCUIT
21: ORGANIC EL LIGHT-EMITTING ELEMENT
100: DISPLAY CONTROL CIRCUIT
200: DISPLAY UNIT
210: FIRST DISPLAY REGION
220: SECOND DISPLAY REGION
230: THIRD DISPLAY REGION
250: CONNECTION CONTROL PART (FIRST CONNECTION CONTROL PART)
252: SWITCH IN THE CONNECTION CONTROL PART (FIRST CONNECTION CONTROL PART)
260: SECOND CONNECTION CONTROL PART
262: SWITCH IN THE SECOND CONNECTION CONTROL PART
300: GATE DRIVER
400: EMISSION DRIVER
500: SOURCE DRIVER
SL, SL(1) to SL(J): DATA SIGNAL LINE
SLa, SLa(1) to SLa(J): FIRST DATA SIGNAL LINE
SLbr SLb(1) to SLb(J): SECOND DATA SIGNAL LINE
SLCf SLc(1) to SLc(J): THIRD DATA SIGNAL LINE

The invention claimed is:

1. A display device that displays an image by writing a data signal into a plurality of pixel circuits arranged in a display panel, wherein the display panel includes:

a plurality of data signal lines configured to transmit the data signal;

a plurality of scanning signal lines intersecting the plurality of data signal lines;

the plurality of pixel circuits provided at intersecting portions of the plurality of data signal lines and the plurality of scanning signal lines, the plurality of pixel circuits forming a pixel matrix of a plurality of rows x a plurality of columns;

a data signal line drive circuit configured to apply the data signal to the plurality of data signal lines;

a scanning signal line drive circuit configured to apply a scanning signal to the plurality of scanning signal lines; and a first display region and a second display region in which the plurality of data signal lines are disposed, the first display region and the second display region are arranged side by side in a direction in which the plurality of data signal lines extend, each of the plurality of data signal lines includes a first data signal line disposed in the first display region and a second data signal line disposed in the second display region, the plurality of scanning signal lines include a plurality of first scanning signal lines disposed in the first display region and a plurality of second scanning signal lines disposed in the second display region, the data signal line drive circuit is provided at one edge of the second display region so that the data signal is applied to the second data signal line earlier than the first data signal line, the display panel further includes a first switching element provided for each of the plurality of data signal lines, the first switching element having a control terminal to which a first switching signal is provided, a first conductive terminal connected to the first data signal line, and a second conductive terminal connected to the second data signal line, when the scanning signal line drive circuit applies an on-level scanning signal to any of the plurality of first scanning signal lines, the first switching element is in an on state, when the scanning signal line drive circuit applies an on-level scanning signal to any of the plurality of second scanning signal lines, the first switching element is in an off state, the scanning signal line drive circuit sets a second writing period shorter than a first writing period, the second writing period being a period during which an on-level scanning signal is applied to each of the plurality of second scanning signal lines so that the data signal is written into pixel circuits included in the second display region, and the first writing period being a period during which an on-level scanning signal is applied to each of the plurality of first scanning signal lines so that the data signal is written into pixel circuits included in the first display region, and a transition period for changing a level of the first switching signal so as to change on/off of the first switching element is provided between time of end of a period that appears earlier out of a first vertical scanning period and a second vertical scanning period and time of start of a period that appears later, the first vertical scanning period being a period during which an on-level scanning signal is sequentially applied to the plurality of first scanning signal lines, and the second vertical scanning period being a period during which an on-level scanning signal is sequentially applied to the plurality of second scanning signal lines.

2. The display device according to claim 1, wherein a first vertical scanning period during which an on-level scanning signal is sequentially applied to the plurality of first scanning signal lines is longer than a second vertical scanning period during which an on-level scanning signal is sequentially applied to the plurality of second scanning signal lines.

3. The display device according to claim 2, wherein the scanning signal line drive circuit applies the scanning signal to the plurality of scanning signal lines, based on a scanning clock signal, and a clock frequency of the scanning clock signal set when the first switching element is in an off state is higher than a clock frequency of the scanning clock signal set when the first switching element is in an on state.

4. The display device according to claim 2, wherein the display panel includes:

a plurality of light emission control lines provided so as to correspond to the respective plurality of scanning signal lines; and a light emission control line drive circuit configured to apply a light emission control signal to the plurality of light emission control lines, each of the plurality of pixel circuits includes a light-emitting element whose light emission state is controlled by a light emission control signal applied to a corresponding light emission control line, and a light emission period of light-emitting elements in the pixel circuits included in the first display region is shorter than a light emission period of light-emitting elements in the pixel circuits included in the second display region.

5. The display device according to claim 4, wherein when writing of the data signal into pixel circuits included in each row is performed, a voltage value of the data signal is corrected depending on a length of a light emission period of light-emitting elements in the pixel circuits included in the row.

6. The display device according to claim 2, wherein a length of a vertical flyback period is set such that a vertical period is shorter than a vertical period set when the second vertical scanning period is assumed to have a same length as the first vertical scanning period.

7. The display device according to claim 2, wherein a length of a vertical flyback period is set such that a vertical period has a same length as a vertical period set when the second vertical scanning period is assumed to have a same length as the first vertical scanning period.

8. The display device according to claim 1, wherein a first vertical scanning period during which an on-level scanning signal is sequentially applied to the plurality of first scanning signal lines has a same length as a second vertical scanning period during which an on-level scanning signal is sequentially applied to the plurality of second scanning signal lines.

9. The display device according to claim 8, wherein the scanning signal line drive circuit applies the scanning signal to the plurality of scanning signal lines, based on a scanning clock signal, and a duty ratio of the scanning clock signal set when the first switching element is in an off state differs from a duty ratio of the scanning clock signal set when the first switching element is in an on state.

10. The display device according to claim 1, wherein the display panel includes a third display region provided on an opposite side to the second display region with respect to the first display region, each of the plurality of data signal lines includes a third data signal line disposed in the third display region, in addition to the first data signal line and the second data signal line, and the display panel further includes a second switching element provided for each of the plurality of data signal lines, the second switching element having a control terminal, a first conductive terminal connected to the third data signal line, and a second conductive terminal connected to the first data signal line.

11. The display device according to claim 10, wherein a second switching signal different from the first switching signal is provided to the control terminal of the second switching element.

12. The display device according to claim 11, wherein the plurality of scanning signal lines further include a plurality of third scanning signal lines disposed in the third display region, when the scanning signal line drive circuit applies an on-level scanning signal to any of the plurality of third scanning signal lines, the first switching element is in an on state and the second switching element is in an on state, when the scanning signal line drive circuit applies an on-level scanning signal to any of the plurality of first scanning signal lines, the first switching element is in an on state and the second switching element is in an off state, and when the scanning signal line drive circuit applies an on-level scanning signal to any of the plurality of second scanning signal lines, the first switching element is in an off state and the second switching element is in an off state.

13. The display device according to claim 1, wherein the display panel includes:

a plurality of light emission control lines provided so as to correspond to the respective plurality of scanning signal lines; and a light emission control line drive circuit configured to apply a light emission control signal to the plurality of light emission control lines, and each of the plurality of pixel circuits includes an organic light-emitting diode serving as a light-emitting element whose light emission state is controlled by a light emission control signal applied to a corresponding light emission control line.

14. A display device that displays an image by writing a data signal into a plurality of pixel circuits arranged in a display panel, wherein the display panel includes:

a plurality of data signal lines configured to transmit the data signal;

a plurality of scanning signal lines intersecting the plurality of data signal lines;

the plurality of pixel circuits provided at intersecting portions of the plurality of data signal lines and the plurality of scanning signal lines, the plurality of pixel circuits forming a pixel matrix of a plurality of rows x a plurality of columns;

a data signal line drive circuit configured to apply the data signal to the plurality of data signal lines;

a scanning signal line drive circuit configured to apply a scanning signal to the plurality of scanning signal lines; and a first display region and a second display region in which the plurality of data signal lines are disposed, the first display region and the second display region are arranged side by side in a direction in which the plurality of data signal lines extend, each of the plurality of data signal lines includes a first data signal line disposed in the first display region and a second data signal line disposed in the second display region, the plurality of scanning signal lines include a plurality of first scanning signal lines disposed in the first display region and a plurality of second scanning signal lines disposed in the second display region, the data signal line drive circuit is provided at one edge of the second display region so that the data signal is applied to the second data signal line earlier than the first data signal line, the display panel further includes a first switching element provided for each of the plurality of data signal lines, the first switching element having a control terminal to which a first switching signal is provided, a first conductive terminal connected to the first data signal line, and a second conductive terminal connected to the second data signal line, when the scanning signal line drive circuit applies an on-level scanning signal to any of the plurality of first scanning signal lines, the first switching element is in an on state, when the scanning signal line drive circuit applies an on-level scanning signal to any of the plurality of second scanning signal lines, the first switching element is in an off state, as display modes, a first mode in which drive frequency is a first frequency and a second mode in which drive frequency is a second frequency higher than the first frequency are prepared, in the first mode, a first writing period has a same length as a second writing period, the first writing period being a period during which an on-level scanning signal is applied to each of the plurality of first scanning signal lines so that the data signal is written into pixel circuits included in the first display region, and the second writing period being a period during which an on-level scanning signal is applied to each of the plurality of second scanning signal lines so that the data signal is written into pixel circuits included in the second display region, and in the second mode, the second writing period is shorter than the first writing period.

15. A display device that displays an image by writing a data signal into a plurality of pixel circuits arranged in a display panel, wherein the display panel includes:

a plurality of data signal lines configured to transmit the data signal;

a plurality of scanning signal lines intersecting the plurality of data signal lines;

the plurality of pixel circuits provided at intersecting portions of the plurality of data signal lines and the plurality of scanning signal lines, the plurality of pixel circuits forming a pixel matrix of a plurality of rows x a plurality of columns;

a data signal line drive circuit configured to apply the data signal to the plurality of data signal lines;

a scanning signal line drive circuit configured to apply a scanning signal to the plurality of scanning signal lines; and a first display region and a second display region in which the plurality of data signal lines are disposed, the first display region and the second display region are arranged side by side in a direction in which the plurality of data signal lines extend, each of the plurality of data signal lines includes a first data signal line disposed in the first display region and a second data signal line disposed in the second display region, the plurality of scanning signal lines include a plurality of first scanning signal lines disposed in the first display region and a plurality of second scanning signal lines disposed in the second display region, the data signal line drive circuit is provided at one edge of the second display region so that the data signal is applied to the second data signal line earlier than the first data signal line, the display panel further includes a first switching element provided for each of the plurality of data signal lines, the first switching element having a control terminal to which a first switching signal is provided, a first conductive terminal connected to the first data signal line, and a second conductive terminal connected to the second data signal line, when the scanning signal line drive circuit applies an on-level scanning signal to any of the plurality of first scanning signal lines, the first switching element is in an on state, when the scanning signal line drive circuit applies an on-level scanning signal to any of the plurality of second scanning signal lines, the first switching element is in an off state, as display modes, a first mode in which drive frequency is a first frequency and a second mode in which drive frequency is a second frequency higher than the first frequency are prepared, in the first mode, a first vertical scanning period has a same length as a second vertical scanning period, the first vertical scanning period being a period during which an on-level scanning signal is sequentially applied to the plurality of first scanning signal lines, and the second vertical scanning period being a period during which an on-level scanning signal is sequentially applied to the plurality of second scanning signal lines, and in the second mode, the second vertical scanning period is shorter than the first vertical scanning period.

16. The display device according to claim 15, wherein the data signal line drive circuit includes:

a data signal generating unit configured to generate the data signal; and a buffer unit including output amplifiers provided for the respective plurality of data signal lines, the buffer unit outputting the data signal to the plurality of data signal lines, and in the first mode, bias currents of the output amplifiers in the second vertical scanning period are smaller than bias currents of the output amplifiers in the first vertical scanning period.

* * * * *